US012065932B2

(12) United States Patent
Hanaoka

(10) Patent No.: US 12,065,932 B2
(45) Date of Patent: Aug. 20, 2024

(54) EXCAVATION TOOL REPLACEMENT DEVICE AND TUNNEL BORING MACHINE

(71) Applicant: UNDERGROUND INFRASTRUCTURE TECHNOLOGIES CORPORATION, Osaka (JP)

(72) Inventor: Yasuharu Hanaoka, Osaka (JP)

(73) Assignee: UNDERGROUND INFRASTRUCTURE TECHNOLOGIES CORPORATION, Osaka (JP)

( * ) Notice: Subject to any disclaimer, the term of this patent is extended or adjusted under 35 U.S.C. 154(b) by 559 days.

(21) Appl. No.: 17/417,699

(22) PCT Filed: Jul. 31, 2019

(86) PCT No.: PCT/JP2019/030075
§ 371 (c)(1),
(2) Date: Jun. 23, 2021

(87) PCT Pub. No.: WO2020/136968
PCT Pub. Date: Jul. 2, 2020

(65) Prior Publication Data

US 2022/0074306 A1 Mar. 10, 2022

(30) Foreign Application Priority Data

Dec. 25, 2018 (JP) ..... 2018-241613

(51) Int. Cl.
*E21D 9/087* (2006.01)
*E21D 9/11* (2006.01)

(52) U.S. Cl.
CPC ..... *E21D 9/087* (2013.01); *E21D 9/11* (2013.01)

(58) Field of Classification Search
CPC .. E21D 9/08; E21D 9/087; E21D 9/10; E21D 9/11; E21B 10/12; E21B 10/20
See application file for complete search history.

(56) References Cited

U.S. PATENT DOCUMENTS

2014/0357461 A1 12/2014 Yokoyama
2017/0101868 A1 4/2017 Duhmeq et al.

FOREIGN PATENT DOCUMENTS

JP 2557169 B 11/1996
JP 2550407 Y2 10/1997
JP H11-229767 A 8/1999
JP 2003-253988 A 9/2003
(Continued)

OTHER PUBLICATIONS

JP 2012041781 (Year: 2012).*
(Continued)

*Primary Examiner* — Sunil Singh
(74) *Attorney, Agent, or Firm* — Pillsbury Winthrop Shaw Pittman, LLP

(57) ABSTRACT

A guide of an excavation tool replacement device includes an inner guide member configured to guide advancing and retreating of an excavation tool, and an outer guide member configured to support the inner guide member such that the inner guide member is movable to a face side and an anti-face side. The inner guide member has, at a face side end thereof, a first sealing member configured to come into close contact with a gate plate from the anti-face side.

6 Claims, 16 Drawing Sheets

(56) References Cited

FOREIGN PATENT DOCUMENTS

| | | | |
|---|---|---|---|
| JP | 3547119 | B2 | 7/2004 |
| JP | 3589653 | B2 | 11/2004 |
| JP | 2012-041781 | A | 3/2012 |
| JP | 2013-151784 | A | 8/2013 |
| JP | 2018-003314 | A | 1/2018 |

OTHER PUBLICATIONS

JP 3589653 (Year: 2004).*
International Search Report dated Oct. 1, 2019, issued in corresponding International Patent Application No. PCT/JP2019/030075 with English translation (4 pgs.).
Request for the Submission of an Opinion dated Jun. 21, 2024, in corresponding Korean Patent Application No. 10-2021-7021998 with English language machine translation (8 pgs.).

* cited by examiner (FIRST EMBODIMENT)

(SECOND EMBODIMENT)

(THIRD EMBODIMENT)

EXCAVATION TOOL REPLACEMENT DEVICE AND TUNNEL BORING MACHINE

CROSS-REFERENCE TO RELATED APPLICATIONS

This application is the U.S. National Stage of PCT/JP2019/030075, filed Jul. 31, 2019, which claims priority to Japanese Patent Application No. 2018-241613, filed Dec. 25, 2018, the entire contents of both of which are herein incorporated by reference in their entireties.

TECHNICAL FIELD

The present invention relates to an excavation tool replacement device and a tunnel boring machine, and more particularly, it relates to techniques for replacing an excavation tool detachably provided on a cutter head.

BACKGROUND ART

An excavation tool replacement device that replaces an excavation tool of a tunnel boring machine is known in general. Such an excavation tool replacement device is disclosed in Japanese Patent No. 3589653, for example.

Japanese Patent No. 3589653 discloses a cutter bit replacement device including a cutter bit, a guide that supports the cutter bit such that the cutter bit is slidable to the anti-face side, a slide gate including a penetration hole through which the cutter bit passes through when the cutter bit protrudes from a cutter face plate, and a gate lid that closes an opening in the front surface of the cutter bit with the cutter bit slid to the anti-face side, a guide member that guides the slide gate, and a sealing member that seals between the guide member and the slide gate around the opening when the slide gate slides. The cutter bit is held in a state of being inserted into a guide case and the guide lid. The guide member includes a slide gate guiding portion of the guide case and a guiding portion lid of the guide lid. The sealing member is provided in a groove formed in the guide case and the guide lid.

PRIOR ART

Patent Document

Patent Document 1: Japanese Patent No. 3589653

SUMMARY OF THE INVENTION

Problems to be Solved by the Invention

In Japanese Patent No. 3589653, when the slide gate opens and closes the opening at the time of replacing the cutter bit, the sealing member between the guide member and the slide gate slides with the slide gate. The sealing member may be damaged by sliding with the slide gate or by earth and sand entering during sliding. When the sealing member is damaged, in addition to a deterioration in sealability, the sealing member may come off when sliding with the slide gate and be caught in a gap between the moving slide gate and the guide member, resulting in malfunction. Therefore, it is preferable to be able to replace the sealing member before the damage of the sealing member progresses.

However, Japanese Patent No. 3589653 does not consider replacement of the sealing member. Although not clearly described in Japanese Patent No. 3589653, in order to replace the sealing member, it is conceivably necessary to disassemble the guide case and the guide lid and remove the slide gate (that is, disassemble the entire cutter bit replacement device) after modifying the ground on the face side to prevent the inflow of earth and sand and muddy water. Therefore, it is not easy to replace the sealing member in the device disclosed in Japanese Patent No. 3589653.

Therefore, it is desired that the sealing member for suppressing the inflow of earth and sand and muddy water when the excavation tool is replaced can be easily replaced.

The present invention has been proposed in order to solve the aforementioned problems, and an object of the present invention is to provide an excavation tool replacement device and a tunnel boring machine in which a sealing member for suppressing the inflow of earth and sand and muddy water when the excavation tool is replaced can be easily replaced.

Means for Solving the Problems

In order to attain the aforementioned object, the excavation tool replacement device according to a first aspect of the present invention is an excavation tool replacement device of a tunnel boring machine, the tunnel boring machine including a rotatable cutter head and an excavation tool provided on a front surface of the cutter head, and the excavation tool replacement device includes the excavation tool configured to be attachable and detachable, a front plate including an opening configured to open to a face side of the cutter head, the opening being configured to allow the excavation tool to pass therethrough, a guide configured to support the excavation tool such that the excavation tool advances and retreats through the opening, and a gate plate provided between the front plate and the guide, the gate plate being configured to be slidable along the front plate, the gate plate being configured to open and close the opening. The guide includes an inner guide member configured to guide the advancing and retreating of the excavation tool, and an outer guide member configured to support the inner guide member such that the inner guide member is movable to the face side and an anti-face side, and the inner guide member has, at a face side end thereof, a first sealing member configured to come into close contact with the gate plate from the anti-face side.

In this description, the "tunnel boring machine" indicates a broad concept including a shield tunnel boring machine used in the shield method, a boring machine used in the jacking method, and a tunnel boring machine used in the mountain tunneling method. The shield tunnel boring machine is a machine that assembles segments while countering an earth pressure and a muddy water pressure from the ground with its body and cutter head, and obtains a thrust reaction force from the assembled segments to dig. The jacking method is a method for advancing a boring machine by adding a tunnel wall (concrete or steel pipe) at a starting portion and pushing it in with boring. The tunnel boring machine is mainly used to bore relatively hard ground such as rock, and is a machine that bores a tunnel without having a face holding function to counter an earth pressure and a muddy water pressure. The "face side" refers to the side on which the ground excavated by the cutter head is located, and may be rephrased as the front side in the boring direction. The "anti-face side" refers to the side (entrance side) opposite to the face side, and may be rephrased as the rear side in the boring direction. The excavation tool is a tool provided on the front surface of the cutter head to excavate earth and sand, and indicates a concept including a cutter bit, a roller bit, and the like.

The excavation tool replacement device according to the first aspect of the present invention is configured as described above such that the inner guide member is moved to the anti-face side along the outer guide member. Thus, the first sealing member provided at the face side end of the inner guide member can be exposed from the outer guide member to the anti-face side such that a replacement operation for the first sealing member can be performed. That is, the inner guide member of the inner and outer double guide member is pulled out such that the first sealing member can be replaced without disassembling the entire excavation tool replacement device. Thus, the first sealing member for suppressing the inflow of earth and sand and muddy water when the excavation tool is replaced can be easily replaced.

In the conventional excavation tool replacement device as described in Japanese Patent No. 3589653, when the slide gate is opened and closed, the slide gate moves in a state in which the sealing member comes into close contact with the slide gate, as described above, and thus the first sealing member is damaged due to sliding with the gate plate. In this regard, according to the aforementioned structure of the present invention, the inner guide member including the first sealing member can be moved to the anti-face side, and thus the gate plate can be moved to close the opening with the inner guide member moved to the anti-face side. In this case, due to the movement of the inner guide member to the anti-face side, the gate plate can be moved in a non-contact state in which the first sealing member is separated from the gate plate, or in a state in which the first sealing member contacts the gate plate with a weaker pressing force than at the time of sealing. Consequently, it is possible to suppress wear of the first sealing member due to sliding when the gate plate is moved. After the gate plate is moved, the inner guide member is moved to the face side to bring the first sealing member into close contact with the gate plate such that the sealability can be ensured. Thus, according to the present invention, the first sealing member can be easily replaced while wear of the first sealing member is suppressed such that the number of times of seal replacement can be reduced.

The aforementioned excavation tool replacement device according to the first aspect preferably further includes a second sealing member configured to seal the opening with the excavation tool being arranged at a protruding position on the face side of the cutter head via the opening, and the inner guide member is preferably configured to be movable from the outer guide member to the anti-face side to be pulled out while the excavation tool is arranged at the protruding position. Accordingly, with the excavation tool arranged at the protruding position, the inner guide member can be pulled out such that the first sealing member is replaced while the opening is sealed by the second sealing member. Thus, when the inner guide member is moved to the anti-face side, the first sealing member can be easily replaced while the excavation tool is arranged at the protruding position without performing an operation to ensure the seal of the opening.

The aforementioned excavation tool replacement device according to the first aspect preferably further includes a fixing member configured to fix the inner guide member to the outer guide member, and the inner guide member is preferably configured to become movable by a predetermined distance while being connected to the outer guide member via the fixing member upon release of the inner guide member from a fixed state to the outer guide member via the fixing member. The "fixing member" indicates a concept including a bolt (screw), a pin, a key, and the like. Accordingly, when the gate plate is moved, the fixed state of the inner guide member can be released, and the inner guide member can be moved to the anti-face side by the predetermined distance. The inner guide member is moved to the anti-face side such that the first sealing member can be separated from the gate plate, or the gate plate can be moved in a state in which the first sealing member contacts the gate plate with a weaker pressing force than at the time of sealing. Consequently, it is possible to suppress wear of the first sealing member due to sliding when the gate plate is moved. After the gate plate is moved to a closed position, the inner guide member is moved to the face side to bring the first sealing member into close contact with the gate plate and become fixed such that the sealability of the first sealing member can be ensured.

In the aforementioned excavation tool replacement device according to the first aspect, the gate plate preferably has an inclined surface that is inclined to the face side in a direction of closing the opening, and the inclined surface is preferably configured to come into close contact with the first sealing member when the gate plate closes the opening at a closed position. That is, the inclined surface is inclined so as to be spaced farther apart from the first sealing member in the direction of closing the opening. Accordingly, the seal is ensured by contact between the inclined surface and the seal surface (the surface on which the first sealing member is arranged) inclined according to the inclined surface. Therefore, when the gate plate is closed, the inclined surface and the first sealing member do not contact each other for most of the moving distance of the gate plate, and the gate plate and the first sealing member begin to contact each other immediately before the gate plate is arranged at the closed position. When the gate plate is opened, the inclined surface and the first sealing member do not come into contact with each other immediately after the gate plate is separated from the closed position. Consequently, it is possible to suppress wear of the first sealing member due to sliding when the gate plate is moved. Furthermore, it is not necessary to move the inner guide member to the anti-face side, and thus it is possible to suppress wear of the first sealing member without requiring a special operation by an operator.

The aforementioned excavation tool replacement device according to the first aspect preferably further includes a gate guide configured to guide sliding of the gate plate, and the gate guide is preferably configured to guide the gate plate in a direction in which the gate plate is pressed against the first sealing member before the gate plate reaches a closed position at which the gate plate closes the opening. Accordingly, the gate plate can be moved to the vicinity of the closed position in a state in which the first sealing member is separated from the gate plate or in a state in which the first sealing member contacts the gate plate with a weaker pressing force than at the time of sealing. When the gate plate moves to a position before the closed position, the gate guide guides the gate plate toward the first sealing member such that the gate plate and the first sealing member begin to come into close contact with each other. When the gate plate is opened, the gate plate and the first sealing member can be brought into non-contact or the pressing force of the gate plate against the first sealing member can be weakened immediately after the gate plate is separated from the closed position. Consequently, it is possible to suppress wear of the first sealing member due to sliding when the gate plate is opened and closed.

A tunnel boring machine according to a second aspect of the present invention includes a cutter head and an excavation tool provided on a front surface of the cutter head, a cutter drive configured to rotate the cutter head, and an excavation tool replacement device configured to support the excavation tool such that the excavation tool is replaceable. The excavation tool replacement device includes the excavation tool configured to be attachable and detachable, a front plate including an opening configured to open to a face side of the cutter head, the opening being configured to allow the excavation tool to pass therethrough, a guide configured to support the excavation tool such that the excavation tool advances and retreats through the opening, and a gate plate provided between the front plate and the guide, the gate plate being configured to be slidable along the front plate, the gate plate being configured to open and close the opening. The guide includes an inner guide member configured to guide the advancing and retreating of the excavation tool, and an outer guide member configured to support the inner guide member such that the inner guide member is movable to the face side and an anti-face side, and the inner guide member has, at a face side end thereof, a first sealing member configured to come into close contact with the gate plate from the anti-face side.

In the tunnel boring machine according to the second aspect of the present invention, similarly to the first aspect, the inner guide member is moved to the anti-face side along the outer guide member. Thus, the first sealing member provided at the face side end of the inner guide member can be exposed from the outer guide member to the anti-face side such that a replacement operation for the first sealing member can be performed. Thus, the first sealing member for suppressing the inflow of earth and sand and muddy water when the excavation tool is replaced can be easily replaced.

Furthermore, according to the aforementioned structure, the gate plate can be moved to close the opening with the inner guide member moved to the anti-face side, and thus it is possible to suppress wear of the first sealing member due to sliding when the gate plate is moved. Thus, according to the present invention, the first sealing member can be easily replaced while wear of the first sealing member is suppressed such that the number of times of seal replacement can be reduced.

Effect of the Invention

According to the present invention, as described above, the sealing member for suppressing the inflow of earth and sand and muddy water when the excavation tool is replaced can be easily replaced.

MODES FOR CARRYING OUT THE INVENTION

Embodiments embodying the present invention are hereinafter described on the basis of the drawings.

First Embodiment

A tunnel boring machine 1 and an excavation tool replacement device 100 according to a first embodiment of the present invention is now described with reference to FIGS. 1 to 6. An example in which the tunnel boring machine 1 is a shield tunnel boring machine is described below.

Overall Structure of Tunnel Boring Machine

Figure 1:
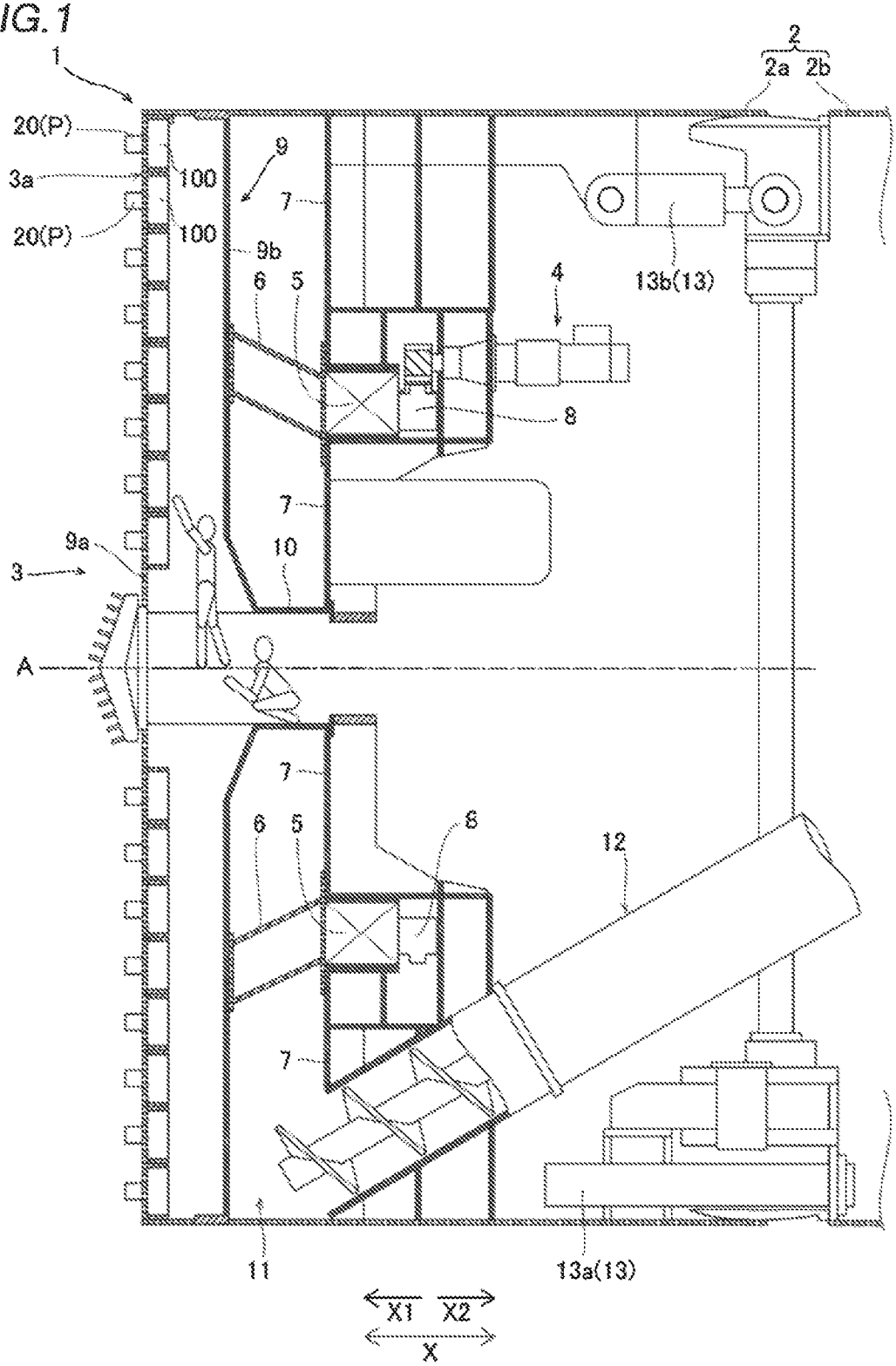
FIG. 1 A schematic longitudinal sectional view of a tunnel boring machine.

As shown in FIG. 1, the tunnel boring machine 1 includes a tubular body 2, a cutter head 3, a cutter drive 4, and excavation tool replacement devices 100.

FIG. 1 illustrates a medium to large diameter-type shield tunnel boring machine employing the intermediate support structure for supporting the cutter head 3. In the intermediate support structure, the cutter head 3 is attached to a rotationally driven annular support member 5 via a cutter column 6. The cutter column 6 is a leg portion that connects the support member 5 to the cutter head 3. The support member 5 is rotatably supported by a slewing bearing 8 provided on a bulkhead 7 of a front body 2*a* described below.

The tunnel boring machine 1 digs in a left direction (X1 direction) in FIG. 1. In FIG. 1, the left side with respect to the cutter head 3 is the face side of a tunnel being bored, and the right side is the anti-face side (entrance side) of the tunnel. In each figure, the forward-rearward direction of the boring direction is shown as an X direction, the front side (face side) in the boring direction is shown as an X1 direction, and the rear side (anti-face side) in the boring direction is shown as an X2 direction. In the following description, the term "front" or "front side" indicates the front side (X1 direction, face side) in the boring direction, and the term "rear" or "rear side" indicates the rear side (X2 direction, anti-face side) in the boring direction.

The body 2 of the tunnel boring machine 1 includes the front body 2*a* and a rear body 2*b*. The body 2 is divided into the front body 2*a* on the front side and the rear body 2*b* on the rear side in the boring direction. Each of the front body 2*a* and the rear body 2*b* has a cylindrical shape, for example. The front body 2*a* is closed on the front side in the boring direction by the bulkhead 7, and the cutter head 3 is held at the position of the front end face of the front body 2*a* via the slewing bearing 8 provided on the bulkhead 7. The rear body 2*b* is connected to a rear end of the front body 2*a* in the boring direction.

The cutter head 3 rotates about a central axis A. The cutter head 3 has a shape corresponding to the end face shape of the front body 2*a* as viewed in the boring direction. That is, the cutter head 3 has a circular shape as viewed in the boring direction.

The cutter head 3 includes a spoke 9 that extends in the radial direction from the central axis A. The spoke 9 is a hollow tubular beam member provided linearly in the radial direction. The central end of the spoke 9 is connected to a hollow center shaft 10 that extends along the central axis A. A front member 9*a* of the spoke 9 constitutes a portion of the front surface 3*a* of the cutter head 3. The cutter column 6 is connected to a rear member 9*b* of the spoke 9.

Excavation tools 20 are arranged on the front surface 3*a* of the cutter head 3. The excavation tools 20 are provided so as to protrude to the front side (the face side) from the front surface 3*a* of the cutter head 3. The excavation tools 20 are tools for excavating the ground with rotation of the cutter head 3. The excavation tools 20 are cutter bits or disk cutters, for example. The excavation tools 20 are detachably provided on the excavation tool replacement devices 100.

The excavation tool replacement devices 100 are installed on the cutter head 3 so as to hold the excavation tools 20 on the front surface 3*a* of the cutter head 3. The excavation tool replacement devices 100 support the excavation tools 20 such that the excavation tools 20 can be replaced. The excavation tool replacement devices 100 are installed inside the hollow spoke 9. The excavation tool replacement devices 100 are fixed to the front member 9*a* of the spoke 9 from the inside of the spoke 9.

The excavation tool replacement devices 100 can hold the excavation tools 20 at protruding positions P that protrude to the face side relative to the front surface 3*a* of the cutter head 3 during boring. In the excavation tool replacement devices 100, the excavation tools 20 can be removed by retreating the excavation tools 20 to the inside of the spoke 9 on the anti-face side relative to the front surface 3*a* of the cutter head 3. With the excavation tool replacement devices 100, a replacement operation for the excavation tools 20 can be performed inside the spoke 9. The details of the excavation tool replacement devices 100 are described below.

The cutter column 6 is a hollow tubular beam member (beam). The cutter column 6 supports the cutter head 3 and rotates together with the cutter head 3. A first end of the cutter column 6 is attached to the cutter head 3, and a second end thereof is attached to the annular support member 5. The support member 5 is rotatably supported by the slewing bearing 8. Thus, the cutter head 3 is rotatably supported about the central axis A by the slewing bearing 8.

The cutter drive 4 rotates the cutter head 3. The cutter drive 4 includes a hydraulic motor, for example. A driving torque is applied to the support member 5 via the slewing bearing by the cutter drive 4 such that the cutter head 3 is rotationally driven about the central axis A.

Soil excavated by the excavation tools 20 enters a chamber 11 inside the cutter head 3. The chamber 11 is a space surrounded by the cutter head 3, the peripheral wall of the front body 2*a*, and the bulkhead 7. The excavated soil in the chamber 11 is conveyed to the inside of the body 2 through the bulkhead 7 by a soil discharger 12, and then discharged to the outside of the tunnel.

The amount of excavated soil discharged by the soil discharger 12 is controlled such that the excavated soil generates a mud pressure in the chamber 11. The mud pressure in the chamber 11 is maintained by the soil discharger 12 so as to be substantially in equilibrium with an earth pressure component (a pressure of soil constituting the ground) of a force that acts on the cutter head 3 from the ground side.

The tunnel boring machine 1 includes thrust jacks 13. The thrust jacks 13 include a shield jack 13*a* that presses segments (not shown) to propel the body 2 (the front body 2*a* and the rear body 2*b*) and an articulation jack 13*b* that transmits a load from the rear body 2*b* to the front body 2*a*. The tunnel boring machine 1 is propelled to the front side in the boring direction by the thrust forces of these thrust jacks 13.

The tunnel boring machine 1 includes an elector (not shown). The erector is a device that assembles the segments (not shown) into an annular shape (ring shape). The segments assembled into an annular shape construct the wall surface of the tunnel constructed by the tunnel boring machine 1. The tunnel boring machine 1 digs while constructing the tunnel wall surface by repeating excavation at a predetermined distance and assembly of the segments in a state in which digging is stopped.

The center shaft 10 penetrates the bulkhead 7 and is connected to the inside of the body 2. The inside of the body 2 on the rear side relative to the bulkhead 7, the inside of the center shaft 10, and the inside of the spoke 9 are at atmospheric pressure. At the time of replacing the excavation tools 20, an operator can pass through the inside of the center shaft 10 and the inside of the spoke 9 and perform an operation on the excavation tool replacement devices 100.

Excavation Tool Replacement Device

The structure of the excavation tool replacement device 100 is now described with reference to FIGS. 2 to 6. The excavation tool replacement device 100 mainly includes a front plate 31, a guide 32, and a gate plate 33. The excavation tool replacement device 100 includes a tool holder 21 to which the excavation tool 20 is detachably attached. The excavation tool replacement device 100 includes a housing 34 to house the gate plate 33 together with the front plate 31. The guide 32 includes an inner guide member 35 and an outer guide member 36.

The front plate 31 is a flat plate-shaped member provided so as to be exposed on the front surface 3*a* of the cutter head 3. The front plate 31 is provided so as to fit into an opening formed in the front member 9*a* of the spoke 9. The front plate 31 forms a portion of the front surface 3*a* of the cutter head 3. The front plate 31 has an opening 31*a* that opens to the face side of the cutter head 3 and through which the excavation tool 20 passes. The opening 31*a* penetrates the front plate 31 in the thickness direction. The opening 31*a* allows the excavation tool 20 to pass therethrough when the excavation tool 20 is arranged at the protruding position P and when the excavation tool 20 is retreated when the excavation tool 20 is replaced. The opening 31*a* has an opening shape corresponding to the outer shape of the excavation tool 20 such that the excavation tool 20 can pass therethrough.

The excavation tool 20 is attached to the tip end of the cylindrical tool holder 21. The tool holder 21 is arranged inside the guide 32 (inner guide member 35) with the excavation tool 20 facing the face side (front side). The guide 32 supports the tool holder 21 provided with the excavation tool 20 such that the tool holder 21 can advance and retreat in the forward-rearward direction. Thus, the guide 32 supports the excavation tool 20 such that the excavation tool 20 can advance and retreat through the opening 31*a*. A cylindrical extension holder 22 is connected to the rear end of the tool holder 21 by extension bolts 23. The extension holder 22 includes two semi-cylindrical members, and can be separated in half.

The housing 34 is provided so as to cover the rear surface (anti-face side surface) of the front plate 31. The housing 34 includes a gate housing 34*a* to cover the rear surface of the front plate 31. The gate housing 34*a* extends along the front plate 31. A recess 34*b* is provided on a surface of the gate housing 34*a* that faces the front plate 31 to form a space in which the gate plate 33 is arranged between the gate housing 34*a* and the front plate 31. The recess 34*b* of the gate housing 34*a* has a shape that allows the gate plate 33 to move between an open position Q1 (see FIG. 3) and a closed position Q2 (see FIG. 3).

Figure 3:
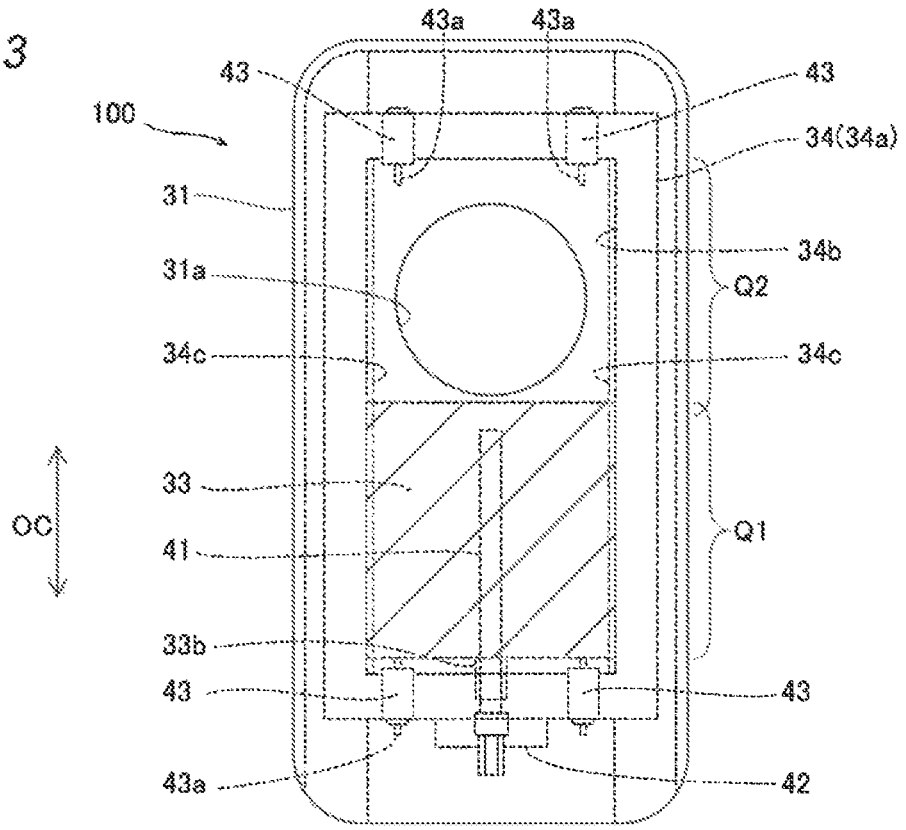
FIG. 3 A schematic view of the excavation tool replacement device as viewed from the front side.

As shown in FIG. 3, the rectangular gate plate 33 linearly moves in an OC direction between the open position Q1 that does not cover the opening 31*a* and the closed position Q2 that covers the opening 31*a*. The recess 34*b* has a rectangular shape according to the moving distance of the gate plate 33 as viewed in the boring direction. A gate guide 34*c* is provided on each of a pair of inner side surfaces of the recess 34*b* that extend along the OC direction. The gate guide 34*c* guides sliding of the gate plate 33. The gate guide 34*c* includes a groove that extends in the OC direction, for example. The side end faces of the gate plate 33 are arranged in the gate guide 34*c*, and both ends of the gate plate 33 are guided in the gate guide 34*c* in the OC direction.

Figure 2:
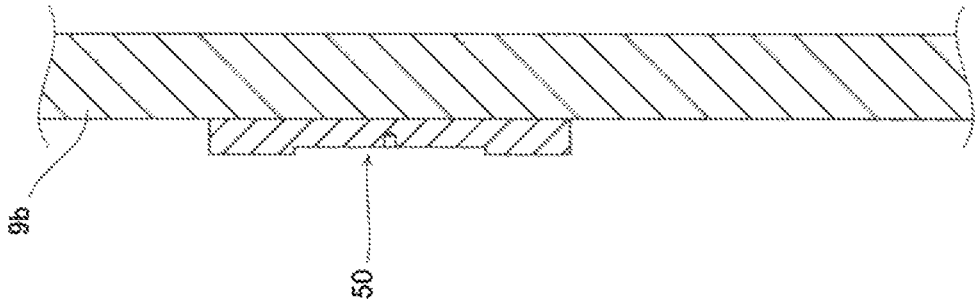
FIG. 2 A schematic sectional view showing an excavation tool replacement device according to a first embodiment.
Figure 2:
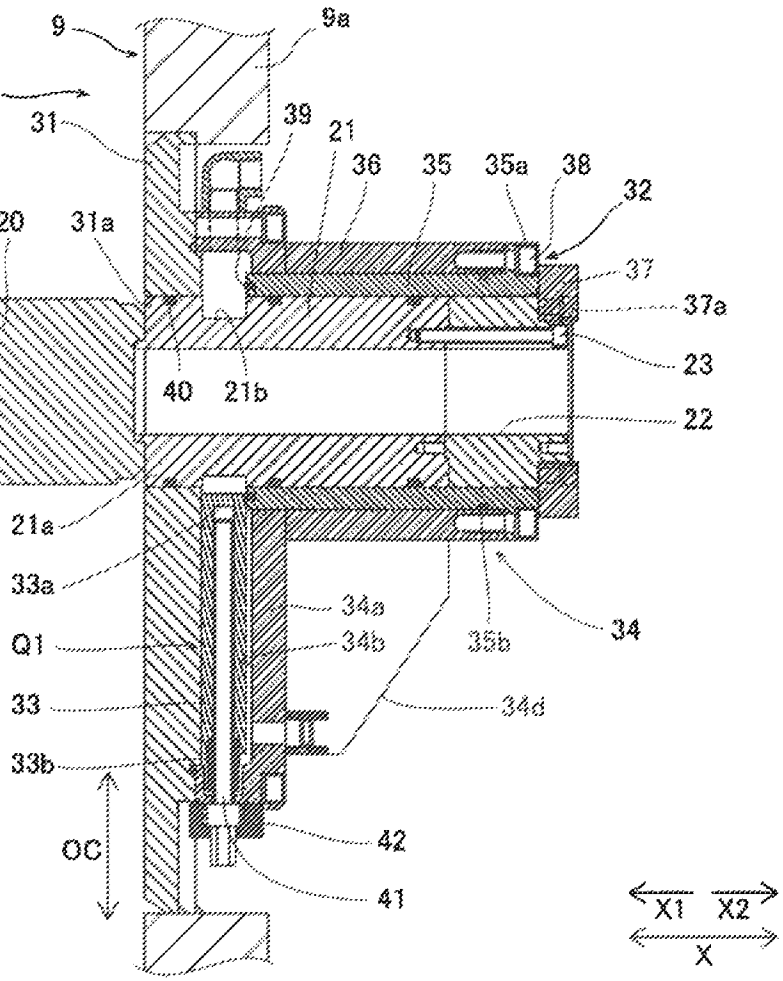

As shown in FIG. 2, the outer guide member 36 that constitutes the guide 32 is provided in the housing 34. The outer guide member 36 is a cylindrical guide cylinder, and the end face thereof on the face side is connected to the rear surface of the gate housing 34*a*. In the gate housing 34*a*, a through-hole that is one size larger than the opening 31*a* is formed on the same axis as the opening 31*a* of the front plate 31 as viewed in the boring direction. The outer guide member 36 has a shape in which the peripheral edge of the through-hole extends to the rear side (anti-face side) in a cylindrical shape. Thus, the housing 34 includes the gate housing 34*a* and the outer guide member 36 integrated with each other by welding, for example. Furthermore, the housing 34 includes a reinforcing rib 34*d* to fix the gate housing 34*a* and the outer guide member 36 to each other.

The outer guide member 36 supports the inner guide member 35 such that the inner guide member 35 is movable to the face side and the anti-face side (forward-rearward direction). That is, the inner guide member 35 is arranged on the inner peripheral portion of the outer guide member 36. The inner guide member 35 is a cylindrical guide cylinder. The inner guide member 35 includes a tubular portion having an outer diameter substantially equal to the inner diameter of the outer guide member 36. The tubular portion of the inner guide member 35 is slidably inserted into the outer guide member 36 in the forward-rearward direction. The inner guide member 35 can move from the outer guide member 36 to the anti-face side to be pulled out while the excavation tool 20 is arranged at the protruding position P.

The inner guide member 35 guides advancing and retreating of the excavation tool 20. The inner guide member 35 supports the tool holder 21 having a tip end to which the excavation tool 20 is attached such that the tool holder 21 is slidable in the forward-rearward direction. The inner diameter of the inner guide member 35 is substantially equal to the inner diameter of the opening 31*a*. The outer diameter of the excavation tool 20 is substantially equal to the inner diameters of the inner guide member 35 and the opening 31*a*. Therefore, the excavation tool 20 can be arranged at the protruding position P by sliding the tool holder 21 to the face side in the inner guide member 35. The protruding position P is a position at which the excavation tool 20 protrudes to the face side (the face side relative to the front plate 31) of the cutter head 3 through the opening 31*a*. The excavation tool 20 can be retreated by sliding the tool holder 21 to the anti-face side in the inner guide member 35. Thus, the excavation tool 20 can be pulled out from the inner guide member 35 together with the tool holder 21 and replaced.

Figure 4:
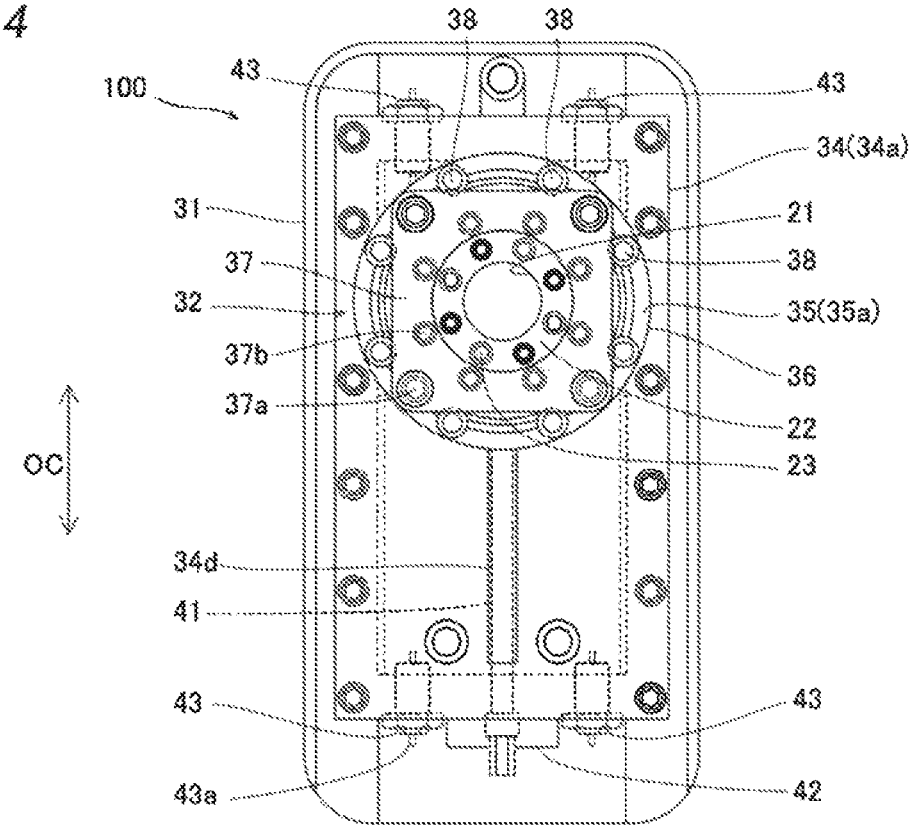
FIG. 4 A schematic view of the excavation tool replacement device as viewed from the rear side.

As shown in FIG. 2, the rear end (anti-face side end) of the inner guide member 35 includes a flange 35*a* that extends outward in the radial direction. The flange 35*a* overlaps the rear end of the outer guide member 36. The inner guide member 35 is fixed to the outer guide member 36 by fixing members 38 that penetrate the flange 35*a* in the forward-rearward direction and are attached to the outer guide member 36. The fixing members 38 are bolts (screws) that fix the inner guide member 35 to the outer guide member 36. As shown in FIG. 4, a plurality of fixing members 38 are provided along the circumferential direction of the flange 35*a*. Although the fixing members 38 do not actually appear on the cross-section shown in FIG. 2, they are shown in FIG. 2 for convenience.

The fixing members 38 are fastened to screw holes formed at the rear end of the outer guide member 36 through through-holes of the flange 35*a*. The inner guide member 35 is fixed to the outer guide member 36 by the fixing members 38. The fixing members 38 penetrate the flange 35*a* from the anti-face side and tighten the flange 35*a* toward the face side with respect to the outer guide member 36. The inner guide member 35 becomes movable by a predetermined distance while being connected to the outer guide member 36 via the fixing member 38 upon release of the inner guide member 35 from a fixed state to the outer guide member 36 via the fixing member 38. That is, when the fixing members 38, which are bolts, are loosened to release the fixed state, the inner guide member 35 can move to the anti-face side by the amount of movement of the fixing members 38 to the anti-face side. When the fixing members 38 are removed, the fixed state of the inner guide member 35 is released. When the fixed state is released, the inner guide member 35 is moved to the anti-face side with respect to the outer guide member 36 and can be pulled out from the outer guide member 36.

Figure 5:
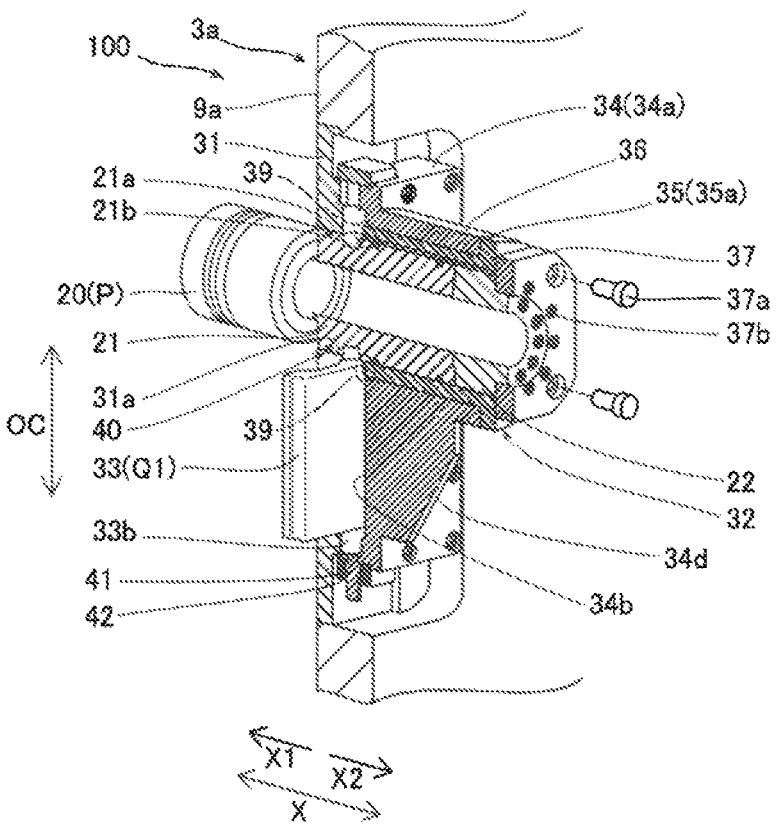
FIG. 5 A schematic perspective sectional view illustrating the structure of the excavation tool replacement device.

As shown in FIG. 2, a fixing flange 37 is attached to the rear end face (the end face on the anti-face side) of the inner guide member 35 by bolts 37*a* (see FIG. 5). The fixing flange 37 is formed so as to straddle the rear end face of the inner guide member 35 and the rear end face of the extension holder 22. The fixing flange 37 is connected to the rear end face of the extension holder 22 by bolts 37*b*. The fixing flange 37 fixes the tool holder 21 inside the inner guide member 35 such that the tool holder 21 does not move in the forward-rearward direction.

In the first embodiment, as shown in FIG. 2, a first sealing member 39 that comes into close contact with the gate plate 33 from the anti-face side is provided at the face side end of the inner guide member 35. The first sealing member 39 is provided in an annular shape along the end face of the cylindrical inner guide member 35 on the face side. The first sealing member 39 is an O-ring, for example. The first sealing member 39 contacts the gate plate 33 at the closed position Q2 in the forward-rearward direction to seal between the gate plate 33 and the inner guide member 35. Thus, with the gate plate 33 arranged at the closed position Q2, it is possible to prevent muddy water or the like entering through the opening 31*a* from entering the inside (the inside of the spoke 9) of the gate plate 33.

The excavation tool replacement device 100 includes a second sealing member 40 that seals the opening 31*a* with the excavation tool 20 being arranged at the protruding position P on the face side of the cutter head 3 through the opening 31*a*. The second sealing member 40 is provided in a circumferential shape (annular shape) along the outer peripheral surface of the tool holder 21. Specifically, the tool holder 21 has a fitting portion 21*a* that fits into the opening 31*a* with the excavation tool 20 being arranged at the protruding position P. The second sealing member 40 is arranged on the outer peripheral surface of the fitting portion 21*a*. Therefore, when the excavation tool 20 is arranged at the protruding position P, the second sealing member 40 seals between the outer peripheral surface of the tool holder 21 (fitting portion 21*a*) and the inner peripheral surface of the opening 31*a*.

The second sealing member 40 is provided not on the inner peripheral surface of the opening 31*a* but on the outer peripheral surface of the tool holder 21, and thus when the tool holder 21 is pulled out from the guide 32 at the time of relacing the excavation tool 20, the second sealing member 40 can be replaced.

As described above, the gate plate 33 is arranged between the front plate 31 and the gate housing 34*a* of the housing 34 (inside the recess 34*b*). Furthermore, the gate plate 33 is arranged between the front plate 31 and the inner guide member 35 in the forward-rearward direction. The gate plate 33 has a flat plate shape that extends along the front plate 31. The gate plate 33 according to the first embodiment has a flat plate shape having a substantially constant thickness in the boring direction. The gate plate 33 has a rectangular shape as viewed in the boring direction (see FIG. 3). The shape of the gate plate 33 may be any shape as long as the gate plate 33 can close the opening 31*a*. The gate plate 33 linearly moves in the OC direction inside the gate housing 34*a*. The gate plate 33 includes a hole 33*a* that extends in the OC direction. A screw shaft 41 is arranged inside the hole 33*a*. The screw shaft 41 meshes with a nut 33*b* fixed to the gate plate 33 at the entrance of the hole 33*a*. When the screw shaft 41 is rotated, the nut 33*b* that meshes with the screw shaft 41 is delivered in the OC direction, and the gate plate 33 moves. Thus, the gate plate 33 (see FIG. 3) linearly moves between the open position Q1, which is a first end in the OC direction, and the closed position Q2, which is a second end in the OC direction.

The screw shaft 41 is rotatably attached to the housing 34. That is, the screw shaft 41 protrudes outward from an end of the gate housing 34*a* and is held by a cover 42. When opening and closing the gate plate 33, the operator rotates an end of the screw shaft 41 that protrudes from the cover 42 to move the gate plate 33.

The gate plate 33 is arranged such that a surface thereof on the anti-face side comes into close contact with the first sealing member 39 of the inner guide member 35 in a fixed state. The face side surface of the gate plate 33 contacts a surface (anti-face side surface) of the front plate 31. Therefore, at the closed position Q2, the gate plate 33 seals a gap on the surface on the anti-face side by contacting the first sealing member 39. At the closed position Q2, the gate plate 33 seals a gap on the surface on the face side by contacting (metal-touching) the front plate 31.

As shown in FIGS. 3 and 4, in the gate housing 34*a* of the housing 34, gate detectors 43 are provided. The gate detectors 43 are provided at both ends of the gate housing 34*a* in the OC direction. The gate detectors 43 each include a rod 43*a* urged so as to penetrate the gate housing 34*a* and protrude into the recess 34*b*. When the gate plate 33 moves, the rod 43*a* is pushed by the gate plate 33 and protrudes from the gate housing 34*a* to the outside (the outside of the housing 34). That is, it can be confirmed that the gate plate 33 has reached the open position Q1 when the rods 43*a* of the gate detectors 43 on the open position Q1 side in the OC direction protrude. It can be confirmed that the gate plate 33 has reached the closed position Q2 when the rods 43*a* of the gate detectors 43 on the closed position Q2 side protrude.

Figure 6:
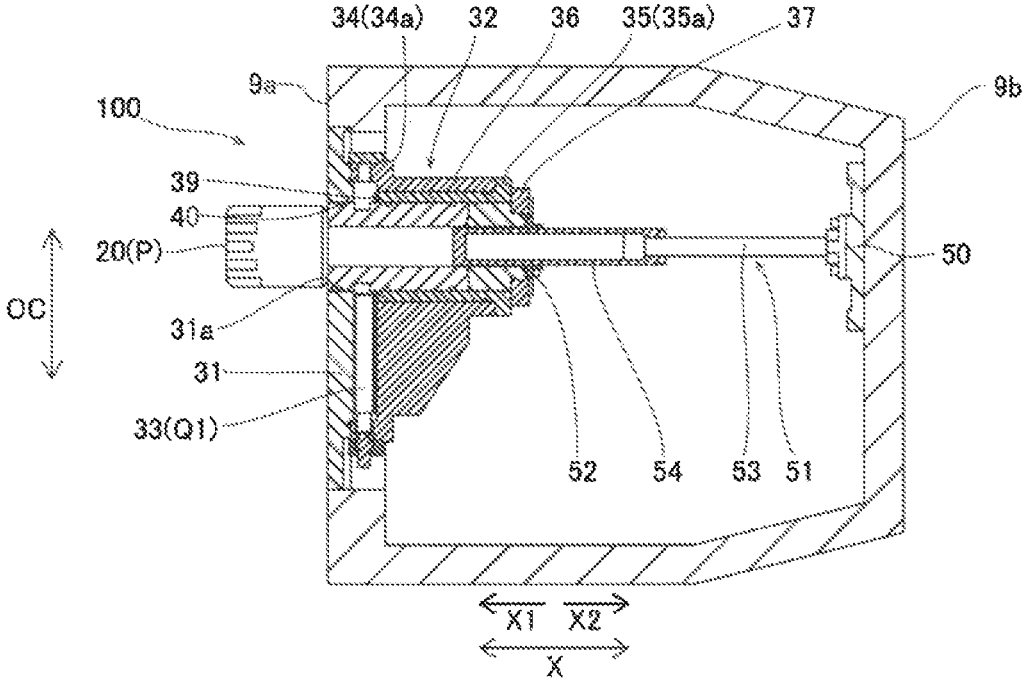
FIG. 6 A schematic sectional view showing a state in which a tool holding jack is attached to the excavation tool replacement device.

Note that when the excavation tool 20 is replaced, the tool holder 21 is pulled out using a tool holding jack 51, as shown in FIG. 6. On the rear member 9*b* of the spoke 9, a jack mount 50 is provided at a position facing the opening 31*a* in the X direction. The tool holding jack 51 has a rear end attached to the jack mount 50 and is arranged toward the front side, and the tip end thereof is inserted into the inner peripheral surface of the tool holder 21. Both the rear end face of the tool holder 21 and the rear end face of the extension holder 22 are screw-fixable to a connecting member 52 of the tool holding jack 51. The tool holding jack 51 can advance and retreat a threaded portion 54 with respect to a shaft 53. A screw (male screw) is formed on the outer peripheral surface of the threaded portion 54. The connecting member 52 is a nut member that meshes with the threaded portion 54. With the tool holding jack 51 extended, the connecting member 52 is connected to the tool holder 21 or the extension holder 22 and the tool holding jack 51 is retracted such that the tool holder 21 can be moved to the anti-face side together with the connecting member 52.

Method for Replacing First Sealing Member

A method for replacing the first sealing member 39 is now described. In the first embodiment, the inner guide member 35 is pulled out from the outer guide member 36 while the excavation tool 20 is arranged at the protruding position P such that the first sealing member 39 is replaced.

Figure 7:
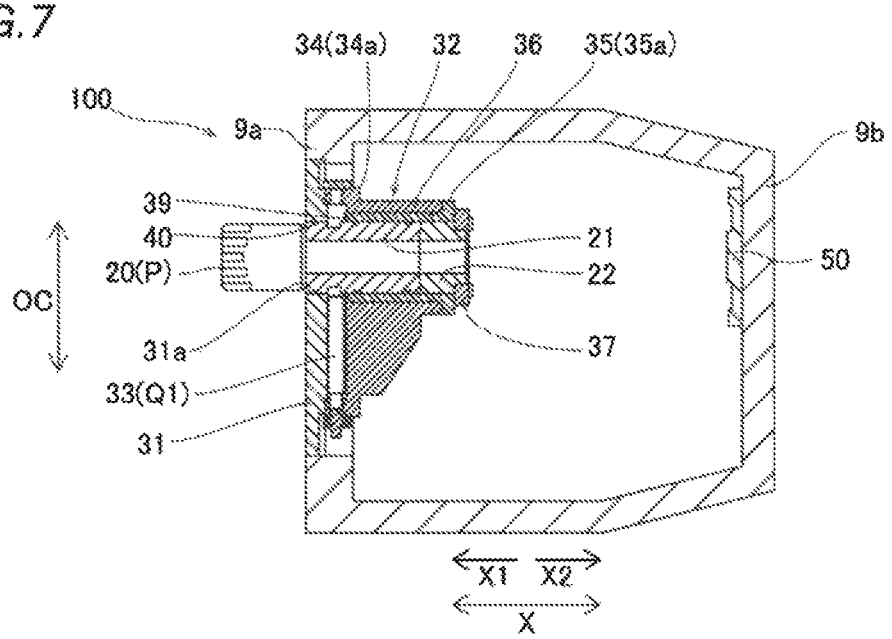
FIG. 7 A schematic sectional view of the excavation tool replacement device during boring.
Figure 8:
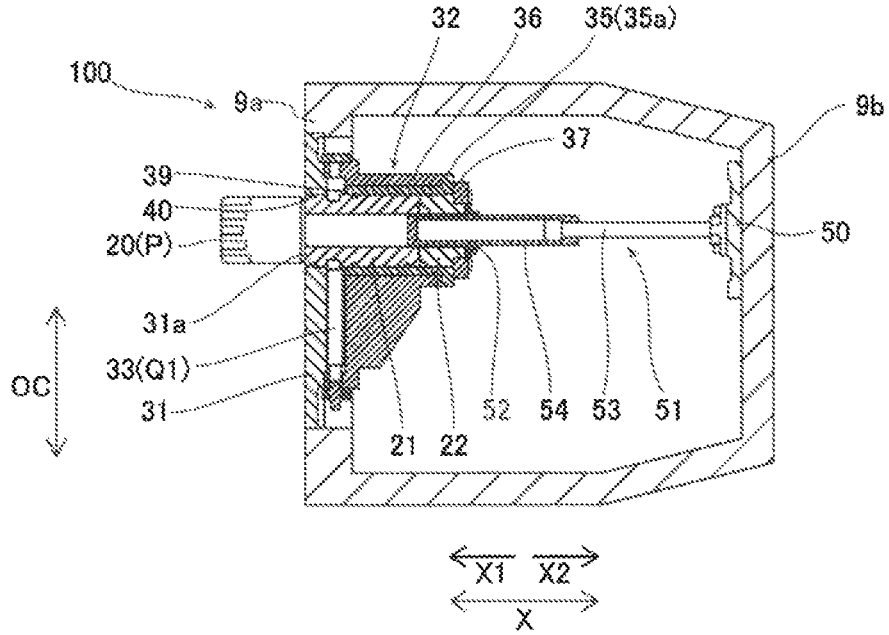
FIG. 8 A sectional view showing attachment of the tool holding jack to the excavation tool replacement device.

As shown in FIG. 7, the method for replacing the first sealing member 39 is described from the state of boring in which the excavation tool 20 is arranged at the protruding position P. As shown in FIG. 8, the operator installs the tool holding jack 51 on the jack mount 50. The operator inserts the threaded portion 54 into the extension holder 22 to connect the connecting member 52 to the rear end of the extension holder 22. Thus, a unit of the excavation tool 20, the tool holder 21, and the extension holder 22 is connected to the tool holding jack 51.

Figure 9:
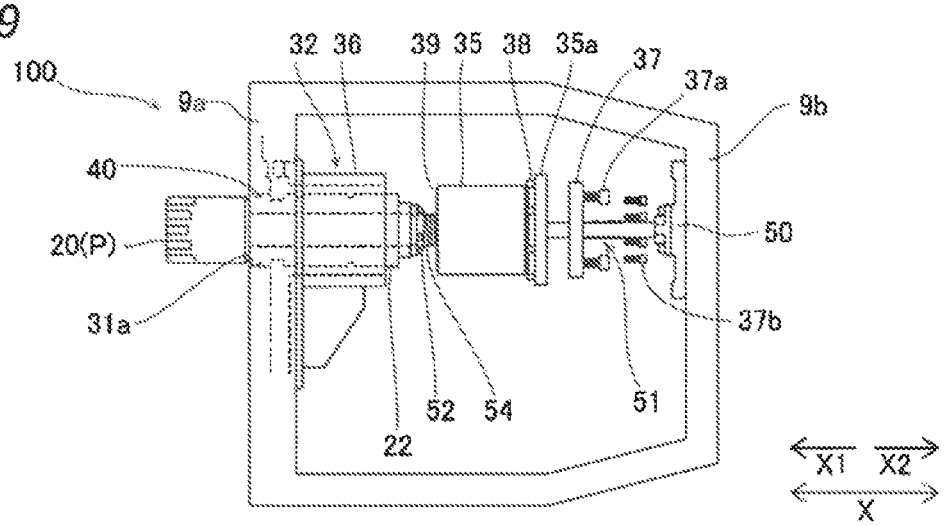
FIG. 9 A schematic side view showing a first stage of a replacement operation for a first sealing member.

As shown in FIG. 9, the operator removes the bolts 37*a* and 37*b* of the fixing flange 37, and then removes the fixing flange 37. Furthermore, the operator removes the fixing members 38 (see FIGS. 2 and 4) to release the fixed state of the inner guide member 35 with respect to the outer guide member 36. Then, the operator pulls out the inner guide member 35. The inner guide member 35 is pulled out to the rear side (the anti-face side) from between the outer guide member 36, and the tool holder 21 and the extension holder 22. The inner guide member 35 is pulled out until it is separated from the outer guide member 36. Thus, the first sealing member 39 at the tip end of the inner guide member 35 is exposed.

At this time, the unit of the excavation tool 20, the tool holder 21, and the extension holder 22 is supported by the tool holding jack 51 with the excavation tool 20 arranged at the protruding position P. The outer side (face side) and the inner side (anti-face side) of the front plate 31 are sealed by the second sealing member 40 (see FIG. 2) provided in the fitting portion 21*a* of the tool holder 21. Therefore, entry of earth and sand or muddy water from the front surface 3*a* side is suppressed by the second sealing member 40.

In a state in which the inner guide member 35 has been pulled out as shown in FIG. 9, the tool holding jack 51 is arranged inside the inner guide member 35, and thus the inner guide member 35 cannot be directly removed. However, the operator can remove the first sealing member 39 from the inner guide member 35 by partially cutting the annular first sealing member 39. Then, in a state in which a new first sealing member 39 is partially cut and arranged on the tip end surface of the inner guide member 35, the cut portion can be joined. Joining can be done by adhesion, vulcanization, or welding, for example. Thus, the first sealing member 39 can be replaced without completely removing the inner guide member 35.

Figure 10:
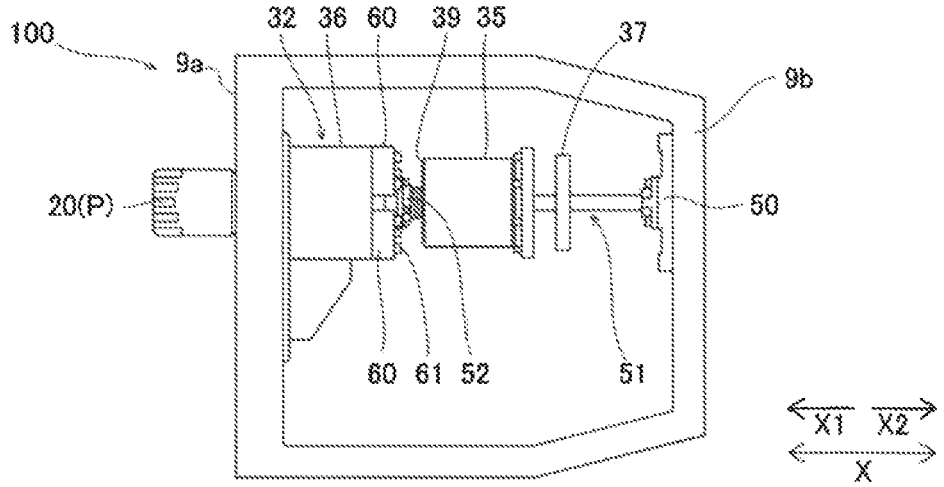
FIG. 10 A schematic side view showing a second stage of the replacement operation for the first sealing member.

When the inner guide member 35 is completely removed, the operator attaches a temporary fixing piece 60 to the outer guide member 36, as shown in FIG. 10. The temporary fixing piece 60 is a pair (two members) of fixing jigs divided into an upper side and a lower side in FIG. 10. The temporary fixing piece 60 is not annular but divided into two members, and thus the temporary fixing piece 60 can be attached even while the tool holding jack 51 is connected to the extension holder 22. The temporary fixing piece 60 is fixed to the end face of the outer guide member 36 and the extension holder 22 by a plurality of bolts 61. Thus, the unit of the excavation tool 20, the tool holder 21, and the extension holder 22 is fixed to the outer guide member 36 via the temporary fixing piece 60.

Figure 11:
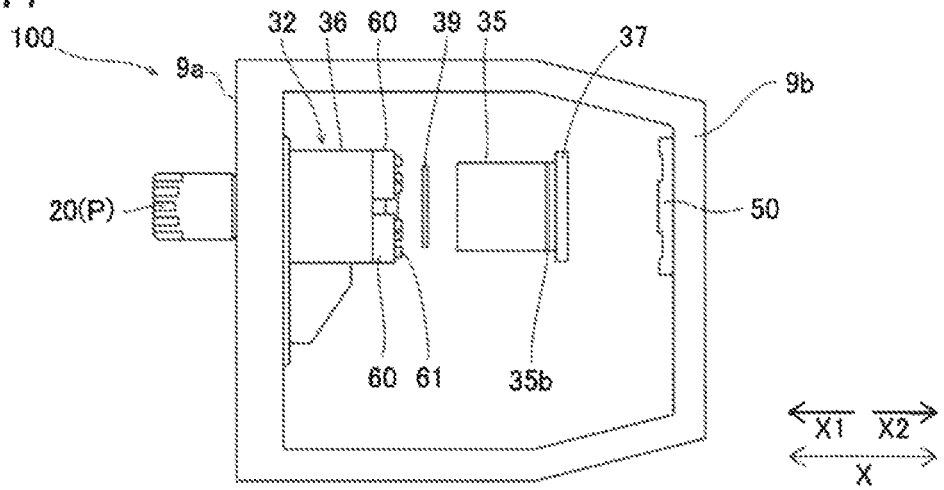
FIG. 11 A schematic side view showing a third stage of the replacement operation for the first sealing member.

Then, the operator removes the connecting member 52 (see FIG. 10) from the extension holder 22 and removes the tool holding jack 51 (see FIG. 10) from the extension holder 22. Thus, as shown in FIG. 11, the tool holding jack 51 that has passed through the inner guide member 35 is removed. The operator can completely remove the inner guide member 35 from the excavation tool replacement device 100. The operator removes the first sealing member 39 from the removed inner guide member 35 and installs a new first sealing member 39. When the inner guide member 35 is completely removed, it is not necessary to cut a portion of the first sealing member 39, and the annular first sealing member 39 can be attached and detached as it is.

After replacing the first sealing member 39, the operator inserts and attaches the inner guide member 35 between the outer guide member 36 and the tool holder 21 (and the extension holder 22) by the reverse procedure of the above. Detailed description thereof is omitted. In the above manner, the first sealing member 39 is replaced.

Method for Replacing Excavation Tool

A method for replacing the excavation tool 20 according to the first embodiment is now described.

Figure 12:
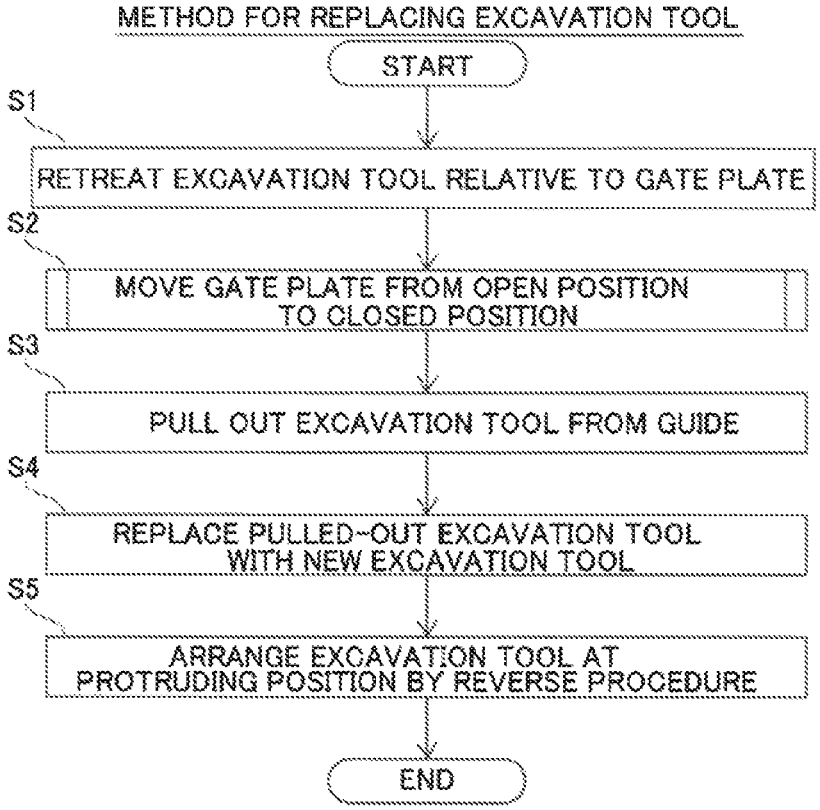
FIG. 12 A flowchart showing the outline of a method for replacing an excavation tool.

First, the outline of the method for replacing the excavation tool 20 is explained. As shown in FIG. 12, the method for replacing the excavation tool 20 is roughly carried out by the operator in the following procedure.

Step S1: Retreat the excavation tool 20 to the position on the anti-face side relative to the gate plate 33.

Step S2: Move the gate plate 33 from the open position Q1 to the closed position Q2.

Step S3: Pull out the excavation tool 20 from the guide 32.

Step S4: Replace the pulled-out excavation tool 20 with a new excavation tool 20.

Step S5: Perform steps S1 to S3 by the reverse procedure, and arrange the new excavation tool 20 at the protruding position P.

Figure 13:
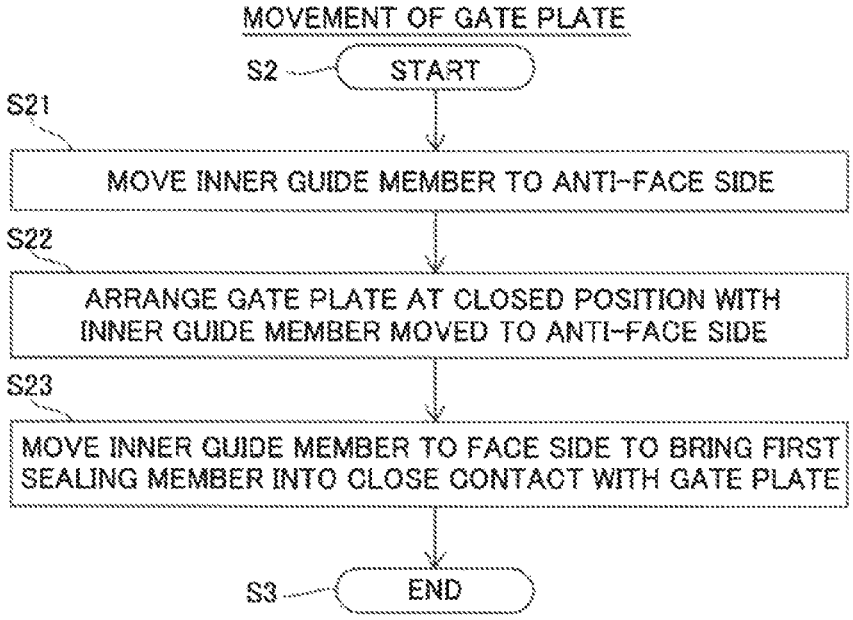
FIG. 13 A flowchart showing the details of movement of a gate plate in the method for replacing the excavation tool.

The method for replacing the excavation tool 20 according to the first embodiment includes the following steps S21 to S23 in step S2 for moving the gate plate 33 from the open position Q1 to the closed position Q2, as shown in FIG. 13.

Step S21: Move the inner guide member 35 to the anti-face side.

Step S22: Arrange the gate plate 33 at the closed position Q2 that closes the opening 31*a* with the inner guide member 35 moved to the anti-face side.

Step S23: Move the inner guide member 35 to the face side to bring the first sealing member 39 into close contact with the gate plate 33 with the gate plate 33 arranged at the closed position Q2.

The specific operation procedure of the method for replacing the excavation tool 20 is described below. As shown in FIG. 7, the method for replacing the excavation tool 20 is described from the state of boring in which the excavation tool 20 is arranged at the protruding position P. As shown in FIG. 8, the operator installs the tool holding jack 51 on the jack mount 50. The operator connects the connecting member 52 to the rear end of the extension holder 22. Thus, the unit of the excavation tool 20, the tool holder 21, and the extension holder 22 is connected to the tool holding jack 51.

Figure 14:
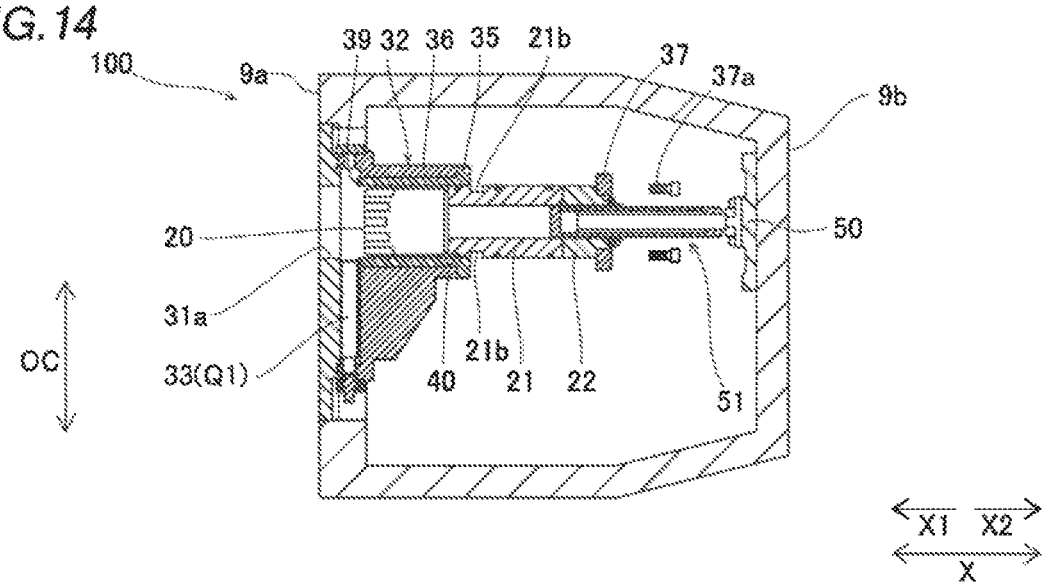
FIG. 14 A schematic sectional view showing a first stage of a replacement operation for the excavation tool.

Then, as shown in FIG. 14, the operator removes the bolts 37*a* of the fixing flange 37 and removes the fixing flange 37 from the inner guide member 35. Then, the operator retracts the tool holding jack 51 by a predetermined stroke. Specifically, the tool holding jack 51 is retracted until the tip end of the excavation tool 20 is arranged on the rear side (anti-face side) relative to the gate plate 33. At this time, the unit of the excavation tool 20, the tool holder 21, and the extension holder 22 is pulled out until a groove 21*b* formed in a circumferential shape on the outer peripheral surface of the tool holder 21 reaches the position of the rear end face of the inner guide member 35. The above is the operation in step S1.

Figure 15:
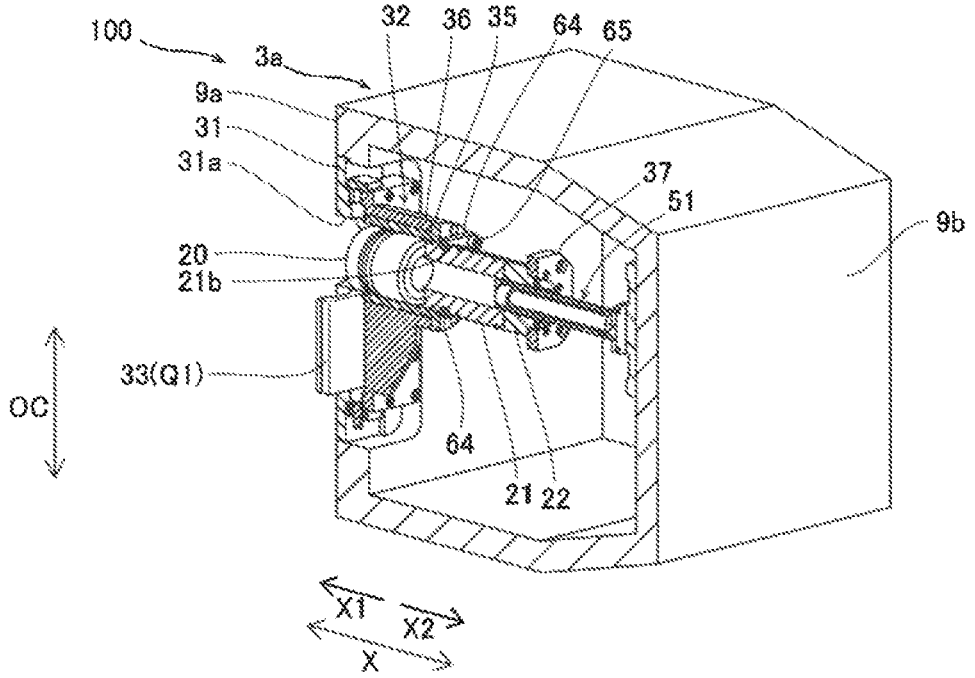
FIG. 15 A schematic perspective sectional view showing a second stage of the replacement operation for the excavation tool.

Then, in step S2, as shown in FIG. 15, the operator attaches a temporary fixing piece 64 to the inner guide member 35 with bolts 65. The temporary fixing piece 64 is a pair (two members) of fixing jigs divided into an upper side and a lower side in FIG. 15. The temporary fixing piece 64 is not annular but divided into two members, and thus the temporary fixing piece 64 can be attached even while the tool holding jack 51 is connected to the extension holder 22. The temporary fixing piece 64 is fixed to the end face of the inner guide member 35 by the bolts 65. The temporary fixing piece 64 is arranged in the groove 21*b* of the tool holder 21. Thus, the unit of the excavation tool 20, the tool holder 21, and the extension holder 22 engages with the inner guide member 35 via the temporary fixing piece 64.

Figure 16:
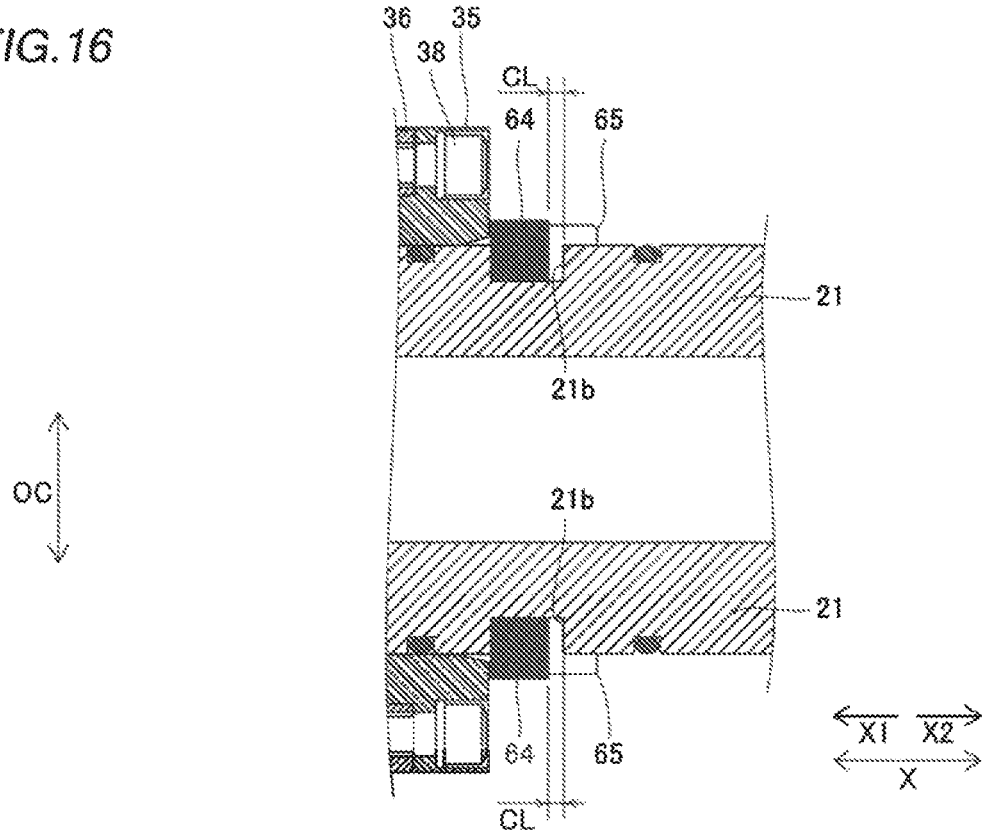
FIG. 16 A schematic enlarged sectional view showing a clearance between a temporary fixing piece and a groove.

As shown in FIG. 16, in the forward-rearward direction (X direction), a length between the inner surfaces of the groove 21*b* of the tool holder 21 is larger than the length of the temporary fixing piece 64 arranged in the groove 21*b*. That is, in the groove 21*b*, there is a clearance CL in the forward-rearward direction between the temporary fixing piece 64 and the inner surface of the groove 21*b*. Therefore, the inner guide member 35 to which the temporary fixing piece 64 has been attached can be moved to the rear side by the amount of clearance CL.

Figure 17:
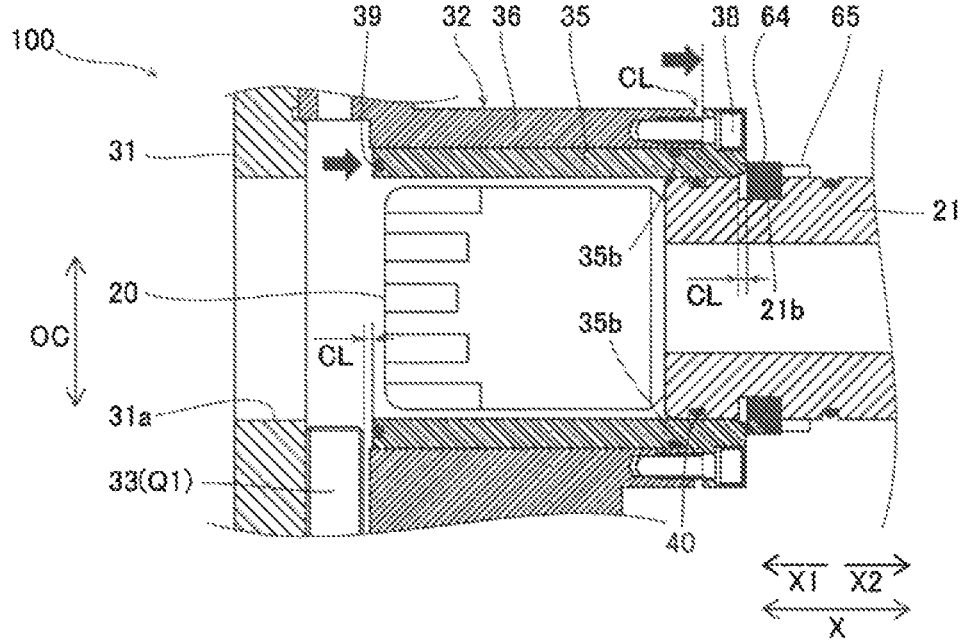
FIG. 17 A schematic enlarged sectional view showing a third stage of the replacement operation for the excavation tool.

Here, the above step S21 is performed. That is, as shown in FIG. 17, the operator loosens the fixing members 38 for fixing the inner guide member 35 to the outer guide member 36. The inner guide member 35 moves to the rear side (anti-face side) as shown by the arrow by the amount of loosening of the fixing members 38, which are bolts. As the inner guide member 35 moves to the rear side, the first sealing member 39 also moves to the rear side. In the first embodiment, the inner guide member 35 is moved to the anti-face side by a predetermined distance CL such that the first sealing member 39 does not contact the gate plate 33 that moves to the closed position Q2. That is, the first sealing member 39 moves to the rear side by the predetermined distance CL from the arrangement position of the end face of the gate plate 33 on the anti-face side.

The size of the clearance CL may be any size as long as the first sealing member 39 does not contact the gate plate 33 that moves to the closed position Q2. The clearance CL may be about several millimeters, such as 5 mm. Thus, when the gate plate 33 is moved to the closed position Q2, the gate plate 33 and the first sealing member 39 does not contact each other.

The tool holder 21 is supported by the tool holding jack 51, and thus it does not move. The inner guide member 35 and the temporary fixing piece 64 move to the rear side in the groove 21*b* without changing the position of the tool holder 21. Furthermore, the inner guide member 35 moves by the above predetermined distance CL while being connected to the outer guide member 36 by the fixing members 38. The operator only loosens the fixing members 38. It is not necessary to remove the fixing members 38, and thus in step S23 described below, the inner guide member 35 can be returned to the face side (front side) only by re-tightening the loosened fixing members 38.

Figure 18:
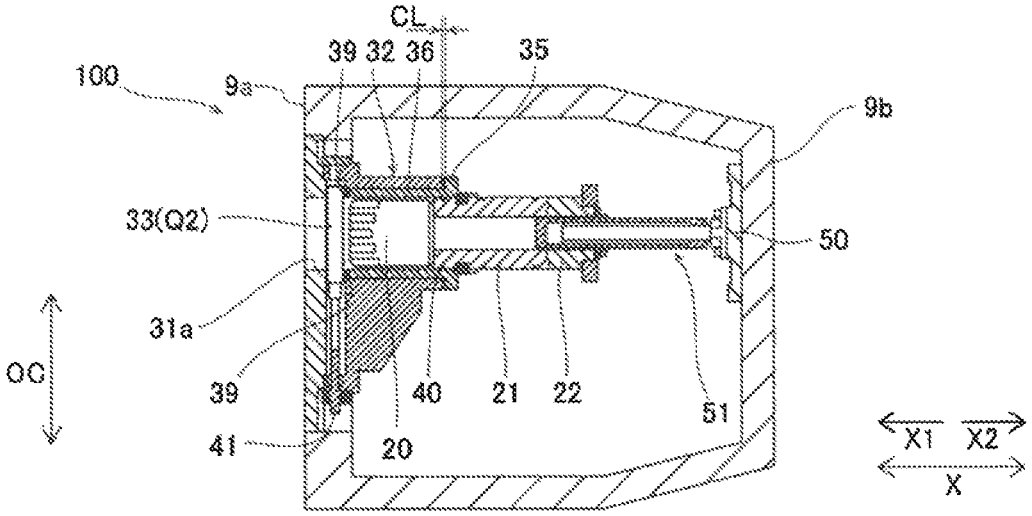
FIG. 18 A schematic sectional view showing a fourth stage of the replacement operation for the excavation tool.

Then, the above step S22 is performed. That is, as shown in FIG. 18, the operator moves the gate plate 33 at the open position Q1 toward the closed position Q2 in the OC direction. The operator rotates the screw shaft 41 to deliver the gate plate 33 toward the closed position Q2. It can be confirmed that the gate plate 33 has reached the closed position Q2 when the rods 43*a* (see FIG. 3) of the gate detectors 43 on the closed position Q2 side protrude. At this time, the inner guide member 35 remains moved to the anti-face side by the predetermined distance CL.

In the first embodiment, when the gate plate 33 moves in step S22, the gate plate 33 moves to the closed position Q2 without contacting the first sealing member 39. At this time, the second sealing member 40 of the fitting portion 21*a* contacts the inner peripheral surface of the inner guide member 35. The second sealing member 40 seals between the inner guide member 35 and the tool holder 21. A third sealing member 35*b* (see FIG. 17) provided on the outer peripheral surface of the inner guide member 35 seals between the inner guide member 35 and the outer guide member 36.

Figure 19:
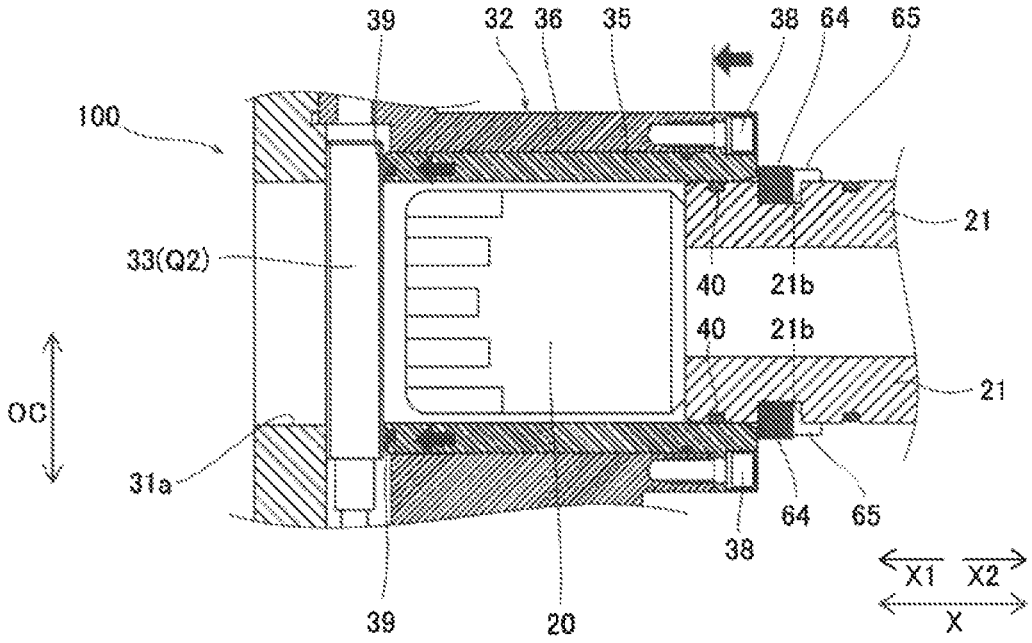
FIG. 19 A schematic enlarged sectional view showing a fifth stage of the replacement operation for the excavation tool.

Then, the above step S23 is performed. That is, as shown in FIG. 19, the operator tightens the fixing members 38 for fixing the inner guide member 35 to the outer guide member 36. As shown by the arrow, the inner guide member 35 moves to the front side (face side) by the amount of tightening of the fixing members 38, which are bolts. The inner guide member 35 moves to the front side by the predetermined distance CL through which the inner guide member 35 has moved to the rear side in step S21 (see FIG. 17). Consequently, the first sealing member 39 at the tip end of the inner guide member 35 comes into contact (close contact) with the anti-face side surface of the gate plate 33 arranged at the closed position Q2. The first sealing member 39 seals between the inner guide member 35 and the gate plate 33. Thus, the inner guide member 35 returns to the fixed state in which the inner guide member 35 is fixed to the outer guide member 36 by the fixing members 38.

Figure 20:
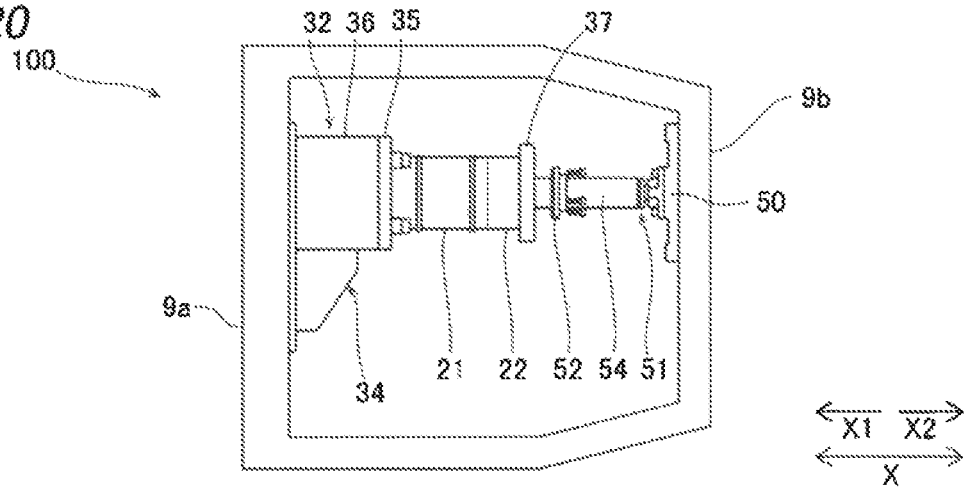
FIG. 20 A schematic side view showing a sixth stage of the replacement operation for the excavation tool.
Figure 21:
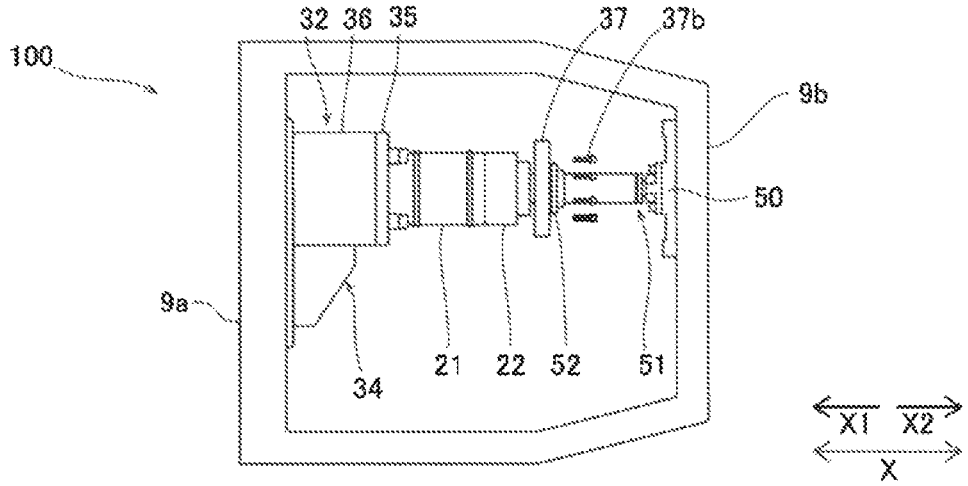
FIG. 21 A schematic side view showing a seventh stage of the replacement operation for the excavation tool.
Figure 22:
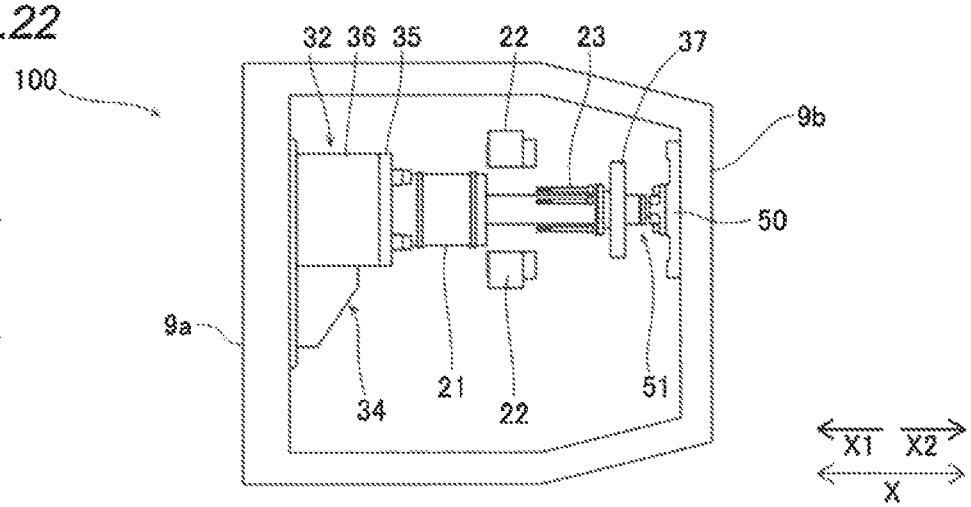
FIG. 22 A schematic side view showing an eighth stage of the replacement operation for the excavation tool.

Then, the operator moves on to the operation in step S3 (see FIG. 12). As shown in FIG. 20, the operator removes the connecting member 52 from the extension holder 22. As shown in FIG. 21, the operator removes the bolts 37*b* and removes the fixing flange 37 from the extension holder 22. Then, as shown in FIG. 22, the operator removes the extension bolts 23 and removes the extension holder 22 from the tool holder 21. The extension holder 22 includes two members, and thus the extension holder 22 can be divided and removed even with the tool holding jack 51 inserted.

Figure 23:
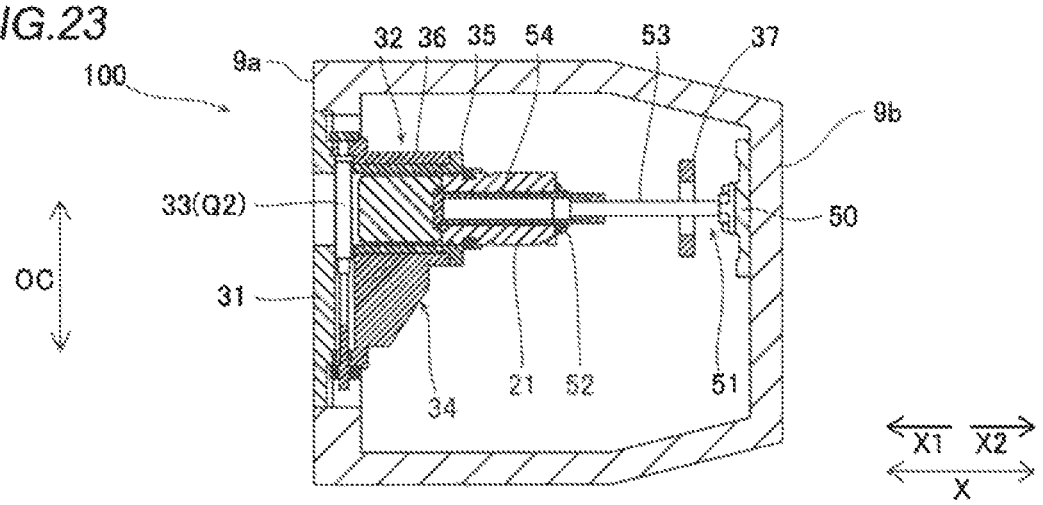
FIG. 23 A schematic sectional view showing a nineth stage of the replacement operation for the excavation tool.
Figure 24:
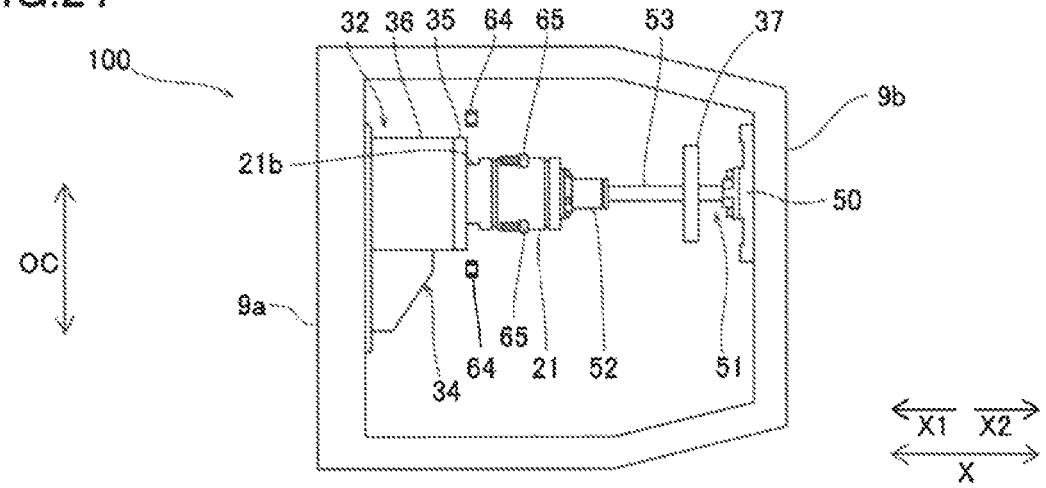
FIG. 24 A schematic side view showing a tenth stage of the replacement operation for the excavation tool.
Figure 25:
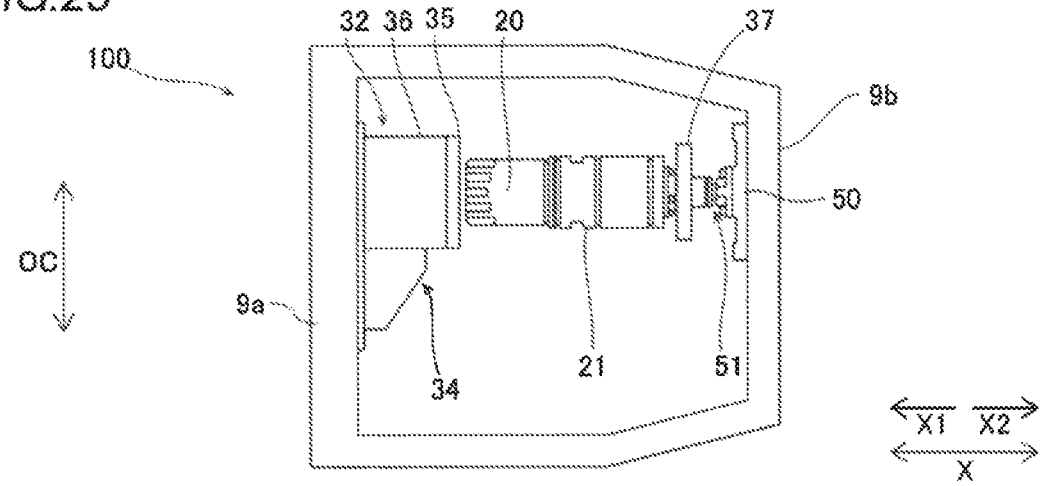
FIG. 25 A schematic side view showing an eleventh stage of the replacement operation for the excavation tool.

Then, as shown in FIG. 23, the operator extends the tool holding jack 51 and inserts the threaded portion 54 into the tool holder 21. Then, the operator attaches the connecting member 52 to the rear end face of the tool holder 21. Then, the operator removes the temporary fixing piece 64, as shown in FIG. 24. Thus, the engagement between the inner guide member 35 and the tool holder 21 is released. Then, as shown in FIG. 25, the operator retracts the tool holding jack 51 and pulls out the excavation tool 20 and the tool holder 21 from the inner guide member 35. Thus, the excavation tool 20 is taken out from the excavation tool replacement device 100.

Then, the operator replaces the taken-out excavation tool 20 with a new excavation tool 20 and attaches it to the excavation tool replacement device 100 (see step S4 in FIG. 12). The operator arranges the new excavation tool 20 at the protruding position P (see step S5 in FIG. 12). This operation is performed by the reverse procedure of the above, and thus detailed description thereof is omitted. When the gate plate 33 is moved from the closed position Q2 to the open position Q1, the fixing members 38 are loosened such that the first sealing member 39 is moved by the predetermined distance CL and does not contact the gate plate 33, as shown in FIG. 17. Therefore, the gate plate 33 moves from the closed position Q2 to the open position Q1 without contacting the first sealing member 39.

In the above manner, the method for replacing the excavation tool 20 according to the first embodiment is carried out.

Advantageous Effects of First Embodiment

According to the first embodiment, the following advantageous effects are achieved.

In the excavation tool replacement device 100 according to the first embodiment, as described above, the guide 32 includes the inner guide member 35 that guides advancing and retreating of the excavation tool 20, and the outer guide member 36 that supports the inner guide member 35 such that the inner guide member 35 is movable to the face side and the anti-face side, and the first sealing member 39 that comes into close contact with the gate plate 33 from the anti-face side is provided at the face side end of the inner guide member 35. Accordingly, the inner guide member 35 is moved to the anti-face side along the outer guide member 36 such that the first sealing member 39 provided at the face side end of the inner guide member 35 can be exposed from the outer guide member 36 to the anti-face side, and the replacement operation for the first sealing member 39 can be performed. That is, the inner guide member 35 of the inner and outer double guide 32 is pulled out such that the first sealing member 39 can be replaced without disassembling the entire excavation tool replacement device 100. Consequently, in the excavation tool replacement device 100 according to the first embodiment, the first sealing member 39 for suppressing the inflow of earth and sand and muddy water when the excavation tool 20 is replaced can be easily replaced.

According to the first embodiment, the inner guide member 35 including the first sealing member 39 can be moved to the anti-face side, and thus by the procedure shown in FIG. 13, the gate plate 33 can be moved to close the opening 31*a* with the inner guide member 35 moved to the anti-face side. The inner guide member 35 is moved to the anti-face side such that the gate plate 33 can be moved in a non-contact state in which the first sealing member 39 is separated from the gate plate 33. Consequently, it is possible to suppress wear of the first sealing member 39 due to sliding when the gate plate 33 is moved. After the gate plate 33 is moved, the inner guide member 35 is moved to the face side to bring the first sealing member 39 into close contact with the gate plate 33 such that the sealability can be ensured. Thus, according to the first embodiment, the first sealing member 39 can be easily replaced while wear of the first sealing member 39 is suppressed such that the number of times of seal replacement can be reduced.

According to the first embodiment, as described above, the excavation tool replacement device 100 further includes the second sealing member 40 that seals the opening 31*a* in with the excavation tool 20 being arranged at the protruding position P on the face side of the cutter head 3 via the opening 31*a*, and the inner guide member 35 is movable from the outer guide member 36 to the anti-face side to be pulled out while the excavation tool 20 is arranged at the protruding position P. Accordingly, with the excavation tool 20 arranged at the protruding position P, the inner guide member 35 can be pulled out such that the first sealing member 39 is replaced while the opening 31*a* is sealed by the second sealing member 40. Thus, when the inner guide member 35 is moved to the anti-face side, the first sealing member 39 can be easily replaced while the excavation tool 20 is arranged at the protruding position P without performing an operation to ensure the seal of the opening 31*a*.

According to the first embodiment, as described above, the excavation tool replacement device 100 further includes the fixing members 38 that fix the inner guide member 35 to the outer guide member 36, and the inner guide member 35 becomes movable by the predetermined distance CL while being connected to the outer guide member 36 via the fixing member 38 upon release of the inner guide member 35 from the fixed state to the outer guide member 36 via the fixing member 38. Accordingly, when the gate plate 33 is moved, the fixed state of the inner guide member 35 can be released, and the inner guide member 35 can be moved to the anti-face side by the predetermined distance CL. In the first embodiment, the inner guide member 35 is moved to the anti-face side such that the first sealing member 39 can be separated from the gate plate 33. Consequently, it is possible to suppress wear of the first sealing member 39 due to sliding when the gate plate 33 is moved. Furthermore, after the gate plate 33 is moved to the closed position Q2, the inner guide member 35 is moved to the face side to bring the first sealing member 39 into close contact with the gate plate 33 and become fixed such that the sealability of the first sealing member 39 can be ensured.

The tunnel boring machine according to the first embodiment includes the excavation tool replacement device 100 configured as described above such that the first sealing member 39 for suppressing the inflow of earth and sand and muddy water when the excavation tool 20 is replaced can be easily replaced. Furthermore, the gate plate 33 can be moved to close the opening 31*a* with the inner guide member 35 moved to the anti-face side, and thus it is possible to suppress wear of the first sealing member 39 due to sliding when the gate plate 33 is moved. Therefore, the first sealing member 39 can be easily replaced while wear of the first sealing member 39 is suppressed such that the number of times of seal replacement can be reduced.

Second Embodiment

Figure 27:
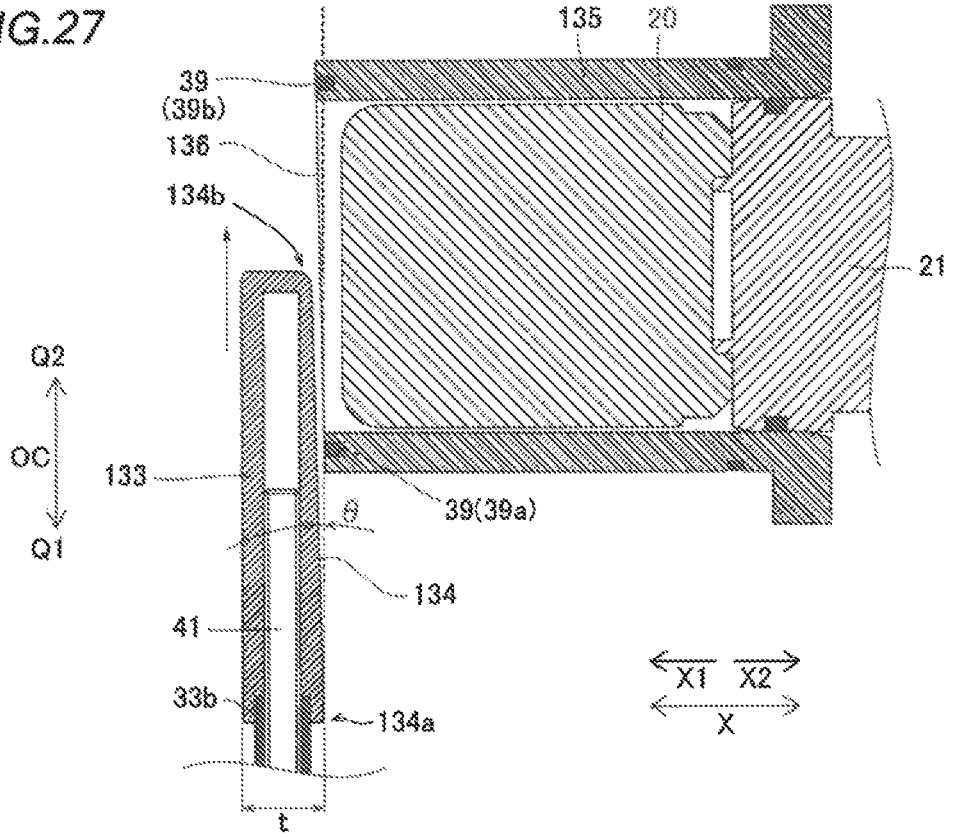
FIG. 27 A schematic enlarged sectional view illustrating an inclined surface of a gate plate.
Figure 28:
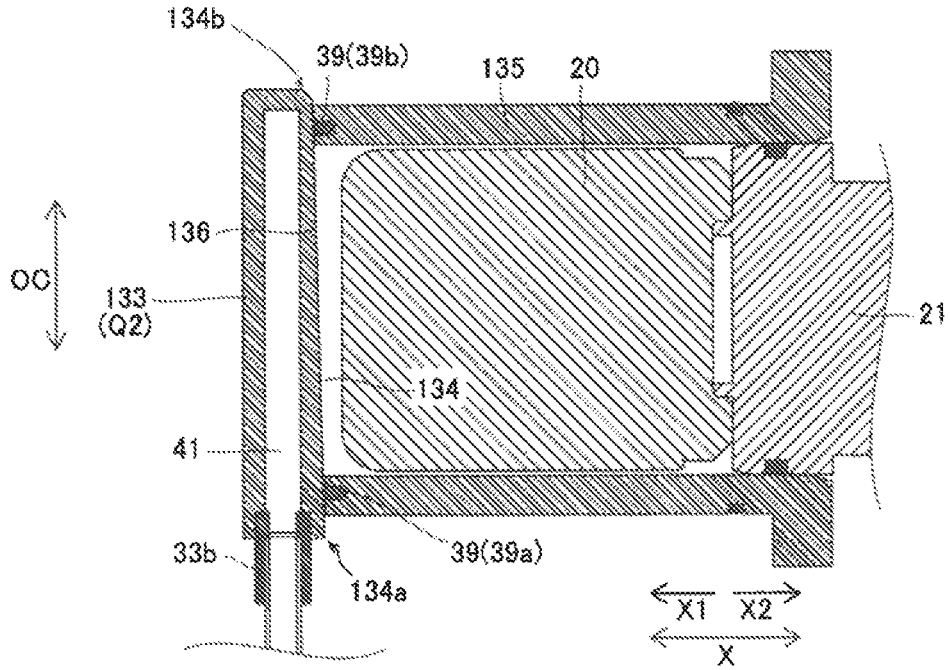
FIG. 28 A schematic enlarged sectional view showing a state in which the gate plate is arranged at a closed position.

A second embodiment is now described with reference to FIGS. 26 to 28. In the second embodiment, an example in which a gate plate 133 has an inclined surface 134 on the anti-face side unlike the aforementioned first embodiment showing the example in which the gate plate 33 has a flat plate shape having a constant thickness is described. In the second embodiment, the same or similar structures as those of the first embodiment are denoted by the same reference numerals, and description thereof is omitted.

Figure 26:
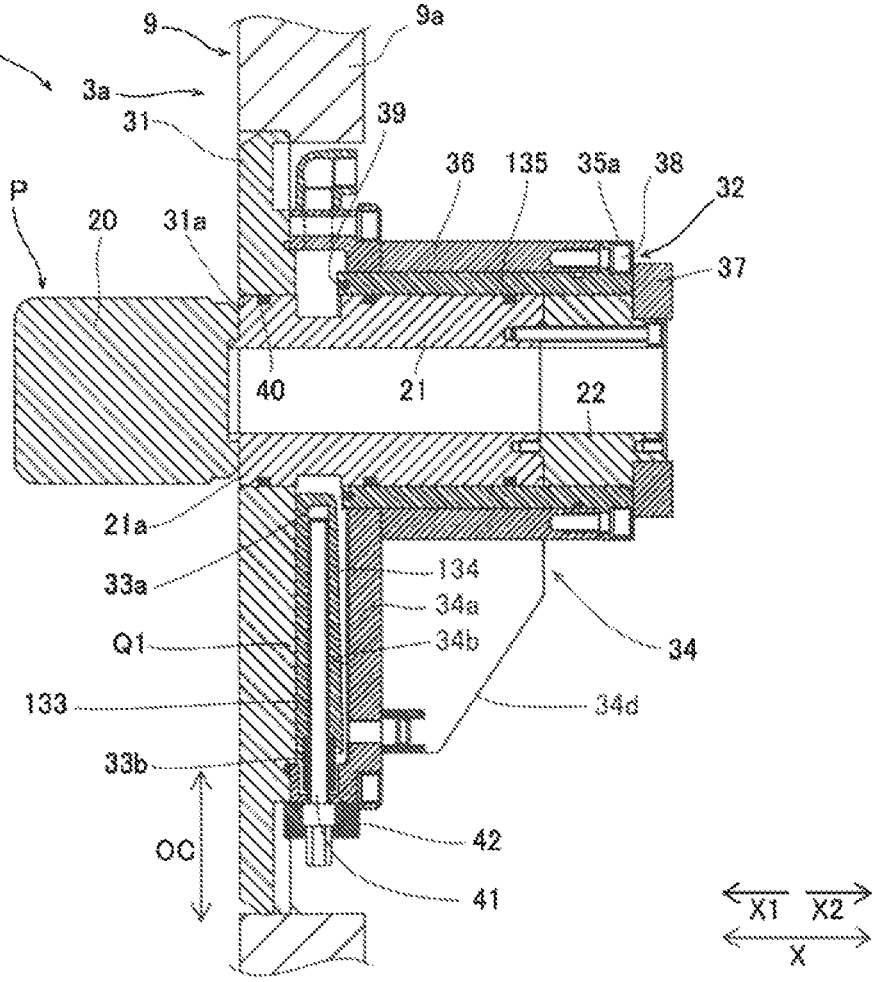
FIG. 26 A schematic sectional view showing an excavation tool replacement device according to a second embodiment.

In the second embodiment, as shown in FIG. 26, a gate plate 133 is provided instead of the gate plate 33 (see FIG. 2). The gate plate 133 has the inclined surface 134 that is inclined to the face side in a direction of closing an opening 31*a* (i.e., toward a closed position Q2). At the closed position Q2 at which the gate plate 133 closes the opening 31*a*, the inclined surface 134 comes into close contact with a first sealing member 39.

Specifically, the gate plate 133 has a first surface on the face side that faces a front plate 31 and a second surface on the anti-face side. The second surface on the anti-face side is the inclined surface 134. As shown in FIG. 27, the inclined surface 134 is arranged at a position at which an end 134*b* on the closed position Q2 side is displaced to the face side (front side) with respect to an end 134*a* on an open position Q1 side. Thus, a surface between the end 134*b* and the end 134*a* is inclined to the front plate 31 side (face side) by an angle θ.

The first surface of the gate plate 133 extends substantially parallel to the front plate 31 along the front plate 31 (see FIG. 26). Therefore, the thickness t of the gate plate 133 in the forward-rearward direction decreases from the end 134*a* on the open position Q1 side to the end 134*b* on the closed position Q2 side. The gate plate 133 moves linearly in an OC direction along the front plate 31.

In the second embodiment, an inner guide member 135 is provided instead of the inner guide member 35 (see FIG. 2). The end face of the inner guide member 135 on the face side is an inclined surface 136 according to the inclined surface 134 of the gate plate 133. That is, the inner guide member 135 has an inclined end face on the face side obtained by cutting a cylinder by a plane inclined by an angle θ. The first sealing member 39 is provided on the end face of the inner guide member 135 on the face side. Therefore, the face side surface of the first sealing member 39 is also inclined by an angle θ such that an end 39*b* on the closed position Q2 side is displaced to the face side (front side) with respect to an end 39*a* on the open position Q1 side.

Thus, in the second embodiment, when the gate plate 133 is moved from the open position Q1 side toward the closed position Q2, the end 134*b* of the inclined surface 134 penetrates without contacting a portion of the first sealing member 39 on the end 39*a* side. When the gate plate 133 reaches the vicinity of the closed position Q2, the end 134*b* of the inclined surface 134 contacts a portion of the first sealing member 39 on the end 39*b* side. That is, the inclined surface 134 of the gate plate 133 does not contact the first sealing member 39 before reaching the vicinity of the closed position Q2, and begins to contact the inclined surface of the first sealing member 39 when reaching the vicinity of the closed position Q2. As shown in FIG. 28, when the gate plate 133 reaches the closed position Q2, the inclined surface 134 and the first sealing member 39 of the inclined surface 136 come into close contact with each other, and the first sealing member 39 seals between the gate plate 133 and the inner guide member 135.

When the gate plate 133 is moved from the closed position Q2 to the open position Q1, the inclined surface 134 and the first sealing member 39 only contact each other in the vicinity of the closed position Q2, and the inclined surface 134 is separated from the first sealing member 39 as it moves toward the open position Q1. Therefore, in the second embodiment, when the gate plate 133 is moved, sliding between the gate plate 133 and the first sealing member 39 is reduced without moving the inner guide member 135 to the anti-face side as in the first embodiment.

The remaining structures of the second embodiment are similar to those of the first embodiment.

Advantageous Effects of Second Embodiment

According to the second embodiment, the following advantageous effects are achieved.

According to the second embodiment, similarly to the first embodiment, the first sealing member 39 for suppressing the inflow of earth and sand and muddy water when an excavation tool 20 is replaced can be easily replaced.

According to the second embodiment, as described above, the gate plate 133 has the inclined surface 134 that is inclined to the face side in the direction of closing the opening 31*a*, and the inclined surface 134 comes into close contact with the first sealing member 39 when the gate plate 133 closes the opening 31*a* at the closed position Q2. That is, the inclined surface 134 is inclined so as to be spaced farther apart from the first sealing member 39 toward the tip end of the gate plate 133 on the closed position Q2 side. Thus, the seal is ensured by contact between the inclined surface 134 and the seal surface (the surface on which the first sealing member 39 is arranged) inclined according to the inclined surface 134. Therefore, when the gate plate 133 is closed, the inclined surface 134 and the first sealing member 39 do not contact each other for most of the moving distance of the gate plate 133, and the gate plate 133 and the first sealing member 39 begin to contact each other immediately before the gate plate 133 is arranged at the closed position Q2. When the gate plate 133 is opened, the inclined surface 134 and the first sealing member 39 do not come into contact with each other immediately after the gate plate 133 is separated from the closed position Q2. Consequently, it is possible to suppress wear of the first sealing member 39 due to sliding when the gate plate 133 is moved. Furthermore, it is not necessary to move the inner guide member 135 to the anti-face side, and thus it is possible to suppress wear of the first sealing member 39 without requiring a special operation by an operator.

The remaining advantageous effects of the second embodiment are similar to those of the first embodiment.

Third Embodiment

A third embodiment is now described with reference to FIGS. 29 to 31. In the third embodiment, an example in which a gate plate 33 slides toward a first sealing member 39 (anti-face side) in the vicinity of a closed position Q2 unlike the aforementioned first embodiment showing the example in which the gate plate 33 moves linearly along the front plate 31 is described. In the third embodiment, the same or similar structures as those of the first embodiment are denoted by the same reference numerals, and description thereof is omitted.

Figure 29:
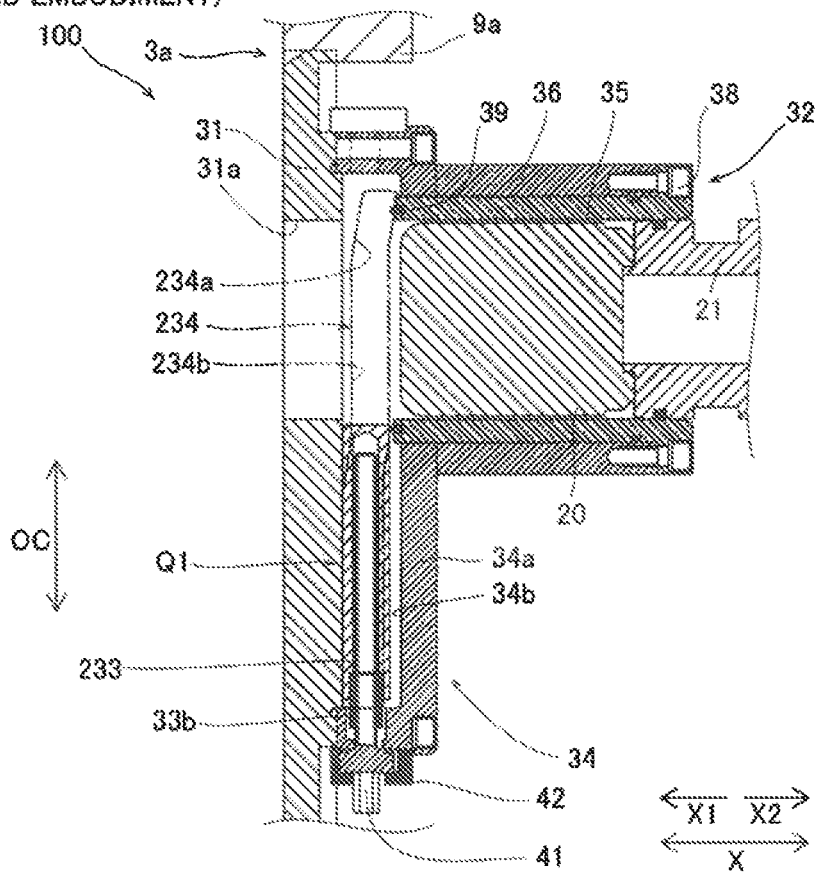
FIG. 29 A schematic sectional view showing an excavation tool replacement device according to a third embodiment.
Figure 30:
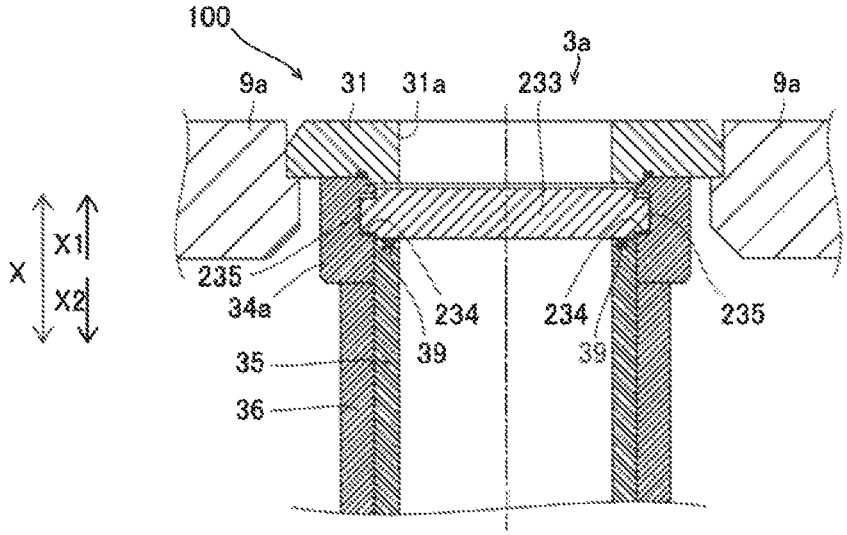
FIG. 30 A schematic transverse sectional view of the excavation tool replacement device for illustrating a gate guide.

In the third embodiment, as shown in FIG. 29, a gate guide 234 (see the two-dot chain line) is provided instead of the gate guide 34*c* (see FIG. 3). A gate plate 233 is provided instead of the gate plate 33 (see FIG. 2). The gate guide 234 guides the gate plate 233 in a direction in which the gate plate 233 is pressed against a first sealing member 39 (i.e., the anti-face side) before the gate plate 233 reaches the closed position Q2 at which the gate plate 233 closes the opening 31*a*.

The formation position of the gate guide 234 is the same as that of the first embodiment (the gate guide 34*c*; see FIG. 2). That is, as shown in FIG. 30, the gate guide 234 is provided on each of a pair of inner side surfaces of a gate housing 34*a* that extend along an OC direction. The gate guide 234 includes a groove. On each of a pair of side end faces of the gate plate 233 along the OC direction, a convex portion 235 that is arranged in the gate guide 234 and moves along the gate guide 234 is provided.

Figure 31:
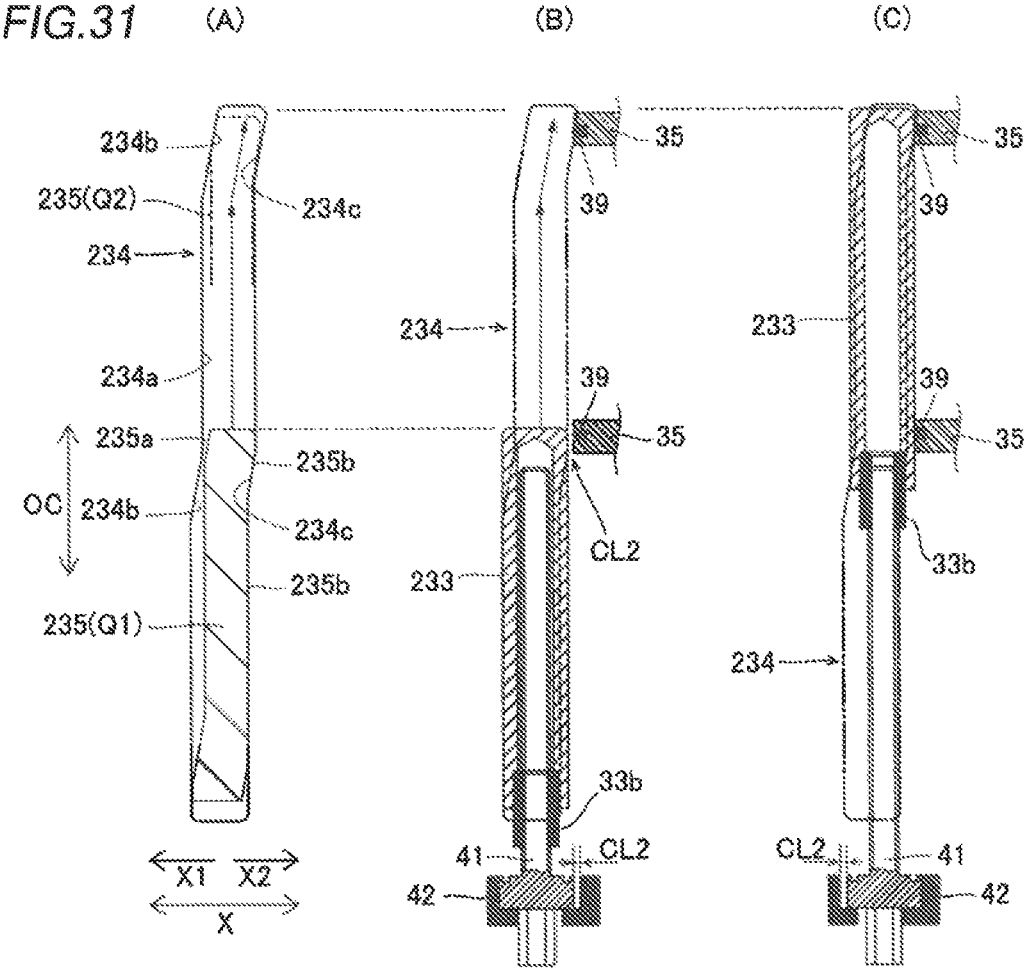
FIG. 31 A view (A) showing the gate guide and a convex portion, a view (B) showing a gate plate at an open position, and a view (C) showing the gate plate at a closed position.

As shown in FIG. 31, unlike the first embodiment, the gate guide 234 according to the third embodiment extends in the OC direction as a whole, but is bent toward the first sealing member 39 (the anti-face side, the inner guide member 35 side) before the closed position Q2.

Specifically, as shown in FIG. 31(A), the gate guide 234 including the groove has a guide surface that is an inner side surface of the groove. The gate guide 234 includes a first guide surface 234*a* that extends linearly in the OC direction and a second guide surface 234*b* inclined to the first sealing member 39 side from a position before the closed position Q2 (a position displaced to the open position Q1 side with respect to the closed position Q2) toward the closed position Q2.

The gate guide 234 guides the gate plate 233 such that the anti-face side surface of the gate plate 233 is separated from the first sealing member 39 to the face side (front side) at the open position Q1. When the gate plate 233 moves toward the closed position Q2 in the OC direction, the second guide surface 234*b* and the face side surface 235*a* of the convex portion 235 contact each other before the closed position Q2. The convex portion 235 moves along the second guide surface 234*b* such that the gate plate 233 moves obliquely to the anti-face side along the inclination direction of the second guide surface 234*b* such that the gate plate 233 approaches the first sealing member 39. In the third embodiment, the gate plate 233 and the first sealing member 39 do not contact each other while the gate plate 233 moves along the first guide surface 234*a*. The gate plate 233 moves obliquely along the second guide surface 234*b* such that the gate plate 233 begins to contact the first sealing member 39.

When the gate plate 233 reaches the closed position Q2, the face side of the convex portion 235 is supported by the second guide surface 234*b* such that a state in which the gate plate 233 is in close contact with the first sealing member 39 is maintained.

When the gate plate 233 moves along the second guide surface 234*b*, a screw shaft 41 that meshes with a nut 33*b* also moves to the first sealing member 39 side (anti-face side). That is, in the third embodiment, a gap CL2 that allows movement to the face side and the anti-face side is provided between an opening of a cover 42 that holds the screw shaft 41 and the screw shaft 41. When an operator turns the screw shaft 41 to move the gate plate 233 to the closed position Q2, the screw shaft 41 slides toward the anti-face side in the opening of the cover 42 as the gate plate 233 moves to the anti-face side.

When the gate plate 233 moves from the closed position Q2 to the open position Q1, a third guide surface 234*c* that faces the second guide surface 234*b* and the anti-face side surface 235*b* of the convex portion 235 contact each other in the gate guide 234, and the convex portion 235 is guided along the third guide surface 234*c*. The third guide surface 234*c* is an inclined surface substantially parallel to the second guide surface 234*b*. Therefore, the gate plate 233 immediately separates from the first sealing member 39 along the second guide surface 234*b*. Thus, in the third embodiment, when the gate plate 233 is moved, sliding between the gate plate 233 and the first sealing member 39 is reduced without moving the inner guide member 35 to the anti-face side as in the first embodiment.

The remaining structures of the third embodiment are similar to those of the first embodiment.

Advantageous Effects of Third Embodiment

According to the third embodiment, the following advantageous effects are achieved.

According to the third embodiment, similarly to the first embodiment, the first sealing member 39 for suppressing the inflow of earth and sand and muddy water when an excavation tool 20 is replaced can be easily replaced.

According to the third embodiment, as described above, the gate guide 234 guides the gate plate 233 in a direction in which the gate plate 233 is pressed against the first sealing member 39 before the gate plate 233 reaches the closed position Q2 at which the gate plate 233 closes the opening 31*a*. Accordingly, the gate plate 233 can be moved to the vicinity of the closed position Q2 in a state in which the first sealing member 39 is separated from the gate plate 233. When the gate plate 233 moves to the position before the closed position Q2, the gate guide 234 guides the gate plate 233 toward the first sealing member 39 such that the gate plate 233 and the first sealing member 39 begin to come into close contact with each other. When the gate plate 233 is opened, the gate plate 233 and the first sealing member 39 can be brought into non-contact immediately after the gate plate 233 is separated from the closed position Q2. Consequently, it is possible to suppress wear of the first sealing member 39 due to sliding when the gate plate 233 is opened and closed.

The remaining advantageous effects of the third embodiment are similar to those of the first embodiment.

Modified Examples

The embodiments and modified examples disclosed this time must be considered as illustrative in all points and not restrictive. The scope of the present invention is not shown by the above description of the embodiments but by the scope of claims for patent, and all modifications (modified examples) within the meaning and scope equivalent to the scope of claims for patent are further included.

For example, while the example in which the tunnel boring machine is a shield tunnel boring machine having the intermediate support structure has been shown in each of the aforementioned first to third embodiments, the present invention is not limited to this. The tunnel boring machine according to the present invention may be applied to shield tunnel boring machines having various support structures such as center shaft support structure, outer circumference support structure, center support structure, and eccentric multiaxial support structure other than the above support structure. Alternatively, the present invention may be applied not to a shield tunnel boring machine but to a boring machine using the pipe jacking method or a tunnel boring machine.

While the example in which the second sealing member 40 is provided has been shown in each of the aforementioned first to third embodiments, the present invention is not limited to this. In the present invention, the second sealing member 40 may not be provided. Furthermore, while the example in which the second sealing member 40 is provided on the outer peripheral surface of the fitting portion 21*a* of the tool holder 21 has been shown in each of the aforementioned first to third embodiments, the second sealing member 40 may be provided at a position other than the outer peripheral surface of the fitting portion 21*a*. For example, the outer diameter of the tool holder 21 may be made larger than the inner diameter of the opening 31*a* such that the tip end surface of the tool holder 21 contacts the peripheral edge of the opening 31*a*. The second sealing member 40 may be provided in an annular shape on the tip end surface of the tool holder 21 at a position at which it contacts the peripheral edge of the opening 31*a*.

While the example in which when the first sealing member 39 is replaced, the inner guide member 35 can be pulled out to the anti-face side with the excavation tool 20 arranged at the protruding position P has been shown in each of the aforementioned first to third embodiments, the present invention is not limited to this. In the present invention, the inner guide member 35 may be pulled out with the excavation tool 20 arranged at a position other than the protruding position P. For example, when replacing the first sealing member 39, the operator may arrange the gate plate 33 at the closed position Q2 and pull out the excavation tool 20 (tool holder 21) in the same manner as when replacing the excavation tool 20. Then, the operator may press the gate plate 33 against the front plate 31 using a dedicated jack (not shown) to bring the gate plate 33 into close contact with the front plate 31. In this state, the inner guide member 35 may be pulled out.

While the example in which the fixing members 38 are loosened such that the inner guide member 35 can move by the predetermined distance CL while being connected to the outer guide member 36 via the fixing members 38 has been shown in each of the aforementioned first to third embodiments, the present invention is not limited to this. In the present invention, the fixing members 38 may be completely removed. The inner guide member 35 may be movable to the face side and the anti-face side only after the fixing members 38 are removed (the fixed state is released).

The fixing members 38 that fix the inner guide member 35 to the outer guide member 36 may be other than bolts. The fixing members 38 may be pins or keys, for example. In that case, the fixing members 38 penetrate the outer guide member 36 and are inserted into engaging holes of the inner guide member 35 to fix the inner guide member 35 to the outer guide member 36, for example.

In each of the aforementioned first to third embodiments, the example in which when the gate plate is moved, the gate plate and the first sealing member 39 do not contact each other at least until just before the closed position Q2 has been shown. That is, in the first embodiment, the inner guide member 35 moves to the anti-face side, and the gate plate 33 and the first sealing member 39 do not come into contact with each other. In the second embodiment, the gate plate 133 has the inclined surface 134 such that the gate plate 133 and the first sealing member 39 do not come into contact with each other. In the third embodiment, the gate guide 234 guides the gate plate 233 such that the gate plate 233 and the first sealing member 39 do not come into contact with each other. The present invention is not limited to these examples. When the gate plate is moved, the gate plate and the first sealing member 39 may come into contact with each other. Even when the gate plate and the first sealing member 39 come into contact with each other, according to the structures of the first to third embodiments, a pressing force from the gate plate to the first sealing member 39 at the time of movement of the gate plate is smaller than a pressing force from the gate plate to the first sealing member 39 with the gate plate arranged at the closed position Q2. Therefore, the frictional resistance is reduced, and thus it is possible to reduce wear of the first sealing member 39 due to sliding with the gate plate.

While the example in which when the gate plate 33 is moved, the inner guide member 35 is moved to the anti-face side such that the gate plate 33 and the first sealing member 39 do not come into contact with each other has been shown in the aforementioned first embodiment, the present invention is not limited to this. In the present invention, the gate plate 33 may be moved while the gate plate 33 and the first sealing member 39 are brought into close contact with each other without moving the inner guide member 35. In that case, the first sealing member 39 is likely to be worn due to sliding, but the first sealing member 39 can be easily replaced by pulling out the inner guide member 35 as described above.

While the example in which the gate plate moves in the OC direction by the screw shaft 41 has been shown in each of the aforementioned first to third embodiments, the present invention is not limited to this. The gate plate may move by any movement path as long as it can move to the open position Q1 and the closed position Q2 along the front plate 31. For example, the gate plate may move to the open position Q1 and the closed position Q2 along the front plate 31 by rotating about a rotation axis that extends in the forward-rearward direction.

While the example in which the excavation tool replacement device 100 is provided on the spoke 9 of the cutter head 3 has been shown in each of the aforementioned first to third embodiments, the present invention is not limited to this. The excavation tool replacement device 100 may be provided on a member other than the spoke as long as it is a member that constitutes the front surface 3*a* of the cutter head 3.

While the example in which the extension holder 22 is attached to the tool holder 21 has been shown in each of the aforementioned first to third embodiments, the present invention is not limited to this. In the present invention, the extension holder 22 may not be provided. That is, in the first embodiment, after the tool holder 21 and the extension holder 22 are pulled out to a predetermined position by the tool holding jack 51 in FIG. 14, the extension holder 22 is removed in FIG. 22, the tool holding jack 51 is attached to the tool holder 21 in FIG. 23, and the tool holder 21 is pulled out by the tool holding jack 51 in FIG. 25, which is a two-stage pulling out operation. When the extension holder 22 is not provided, an operation can be performed by a procedure in which the tool holder 21 is pulled out to a predetermined position by the tool holding jack 51 in FIG. 14 (first stage pulling out), and after the gate plate 33 is closed (see FIG. 18), the operations in FIGS. 20 to 22 are omitted, and the excavation tool 20 is pulled out in FIGS. 23 to 25 (second stage pulling out).

Figure 32:
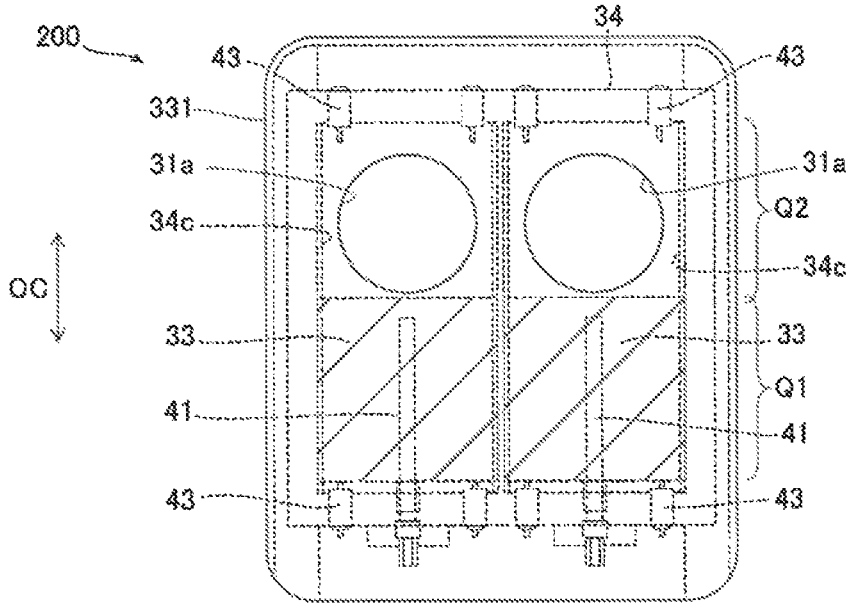
FIG. 32 A schematic front view showing a modified example of an excavation tool replacement device.

While the example in which the excavation tool replacement device 100 holds one excavation tool 20 such that the excavation tool 20 can be replaced has been shown in each of the aforementioned first to third embodiments, the present invention is not limited to this. In the present invention, one excavation tool replacement device 100 may hold a plurality of excavation tools 20 such that the excavation tools 20 can be replaced. For example, FIG. 32 shows an example of an excavation tool replacement device 200 including two openings 31*a* on one front plate 331 and holding two excavation tools 20 such that the two excavation tools 20 can be replaced individually. The excavation tool replacement device 200 includes a gate plate 33 and a guide 32 (not shown in FIG. 32) including an inner guide member 35 and an outer guide member 36 at each of the formation positions of the two openings 31*a*. That is, two structures shown in FIG. 2 are provided in parallel on one front plate 331.

DESCRIPTION OF REFERENCE NUMERALS

1: tunnel boring machine
3: cutter head
3*a*: front surface
4: cutter drive
20: excavation tool
31: front plate
31*a*: opening
32: guide
33, 133, 233: gate plate
35, 135: inner guide member
36: outer guide member
38: fixing member

39: first sealing member
40: second sealing member
100, 200: excavation tool replacement device
134: inclined surface
234: gate guide
331: front plate
CL: predetermined distance
P: protruding position
Q1: open position
Q2: closed position
X1: face side
X2: anti-face side

The invention claimed is:

1. An excavation tool replacement device of a tunnel boring machine, the tunnel boring machine comprising a rotatable cutter head and an excavation tool provided on a front surface of the cutter head, the excavation tool replacement device comprising:

the excavation tool configured to be attachable and detachable;

a front plate comprising an opening configured to open to a face side of the cutter head, the opening being configured to allow the excavation tool to pass therethrough;

a guide configured to support the excavation tool such that the excavation tool advances and retreats through the opening; and a gate plate provided between the front plate and the guide, the gate plate being configured to be slidable along the front plate, the gate plate being configured to open and close the opening, wherein the guide includes an inner guide member configured to guide the advancing and retreating of the excavation tool, and an outer guide member configured to support the inner guide member such that the inner guide member is movable to the face side and an anti-face side, wherein the inner guide member has, at a face side end thereof, a first sealing member configured to come into close contact with the gate plate from the anti-face side, and wherein the excavation tool is attached to a tip end of a tool holder arranged in the inside of the inner guide member.

2. The excavation tool replacement device according to claim 1, further comprising a second sealing member configured to seal the opening with the excavation tool being arranged at a protruding position on the face side of the cutter head via the opening, wherein the inner guide member is configured to be movable from the outer guide member to the anti-face side to be pulled out while the excavation tool is arranged at the protruding position.

3. The excavation tool replacement device according to claim 1, further comprising a fixing member configured to fix the inner guide member to the outer guide member, wherein the inner guide member is configured to be movable by a predetermined distance while being connected to the outer guide member via the fixing member upon release of the inner guide member from a fixed state to the outer guide member via the fixing member.

4. The excavation tool replacement device according to claim 1, wherein the gate plate has an inclined surface that is inclined to the face side in a direction of closing the opening, and wherein the inclined surface is configured to come into close contact with the first sealing member when the gate plate closes the opening at a closed position.

5. The excavation tool replacement device according to claim 1, further comprising a gate guide configured to guide sliding of the gate plate, wherein the gate guide is configured to guide the gate plate in a direction in which the gate plate is pressed against the first sealing member before the gate plate reaches a closed position at which the gate plate closes the opening.

6. A tunnel boring machine comprising:

a cutter head and an excavation tool provided on a front surface of the cutter head;

a cutter drive configured to rotate the cutter head; and an excavation tool replacement device configured to support the excavation tool such that the excavation tool is replaceable, wherein the excavation tool replacement device includes:

the excavation tool configured to be attachable and detachable;

a front plate comprising an opening configured to open to a face side of the cutter head, the opening being configured to allow the excavation tool to pass therethrough;

a guide configured to support the excavation tool such that the excavation tool advances and retreats through the opening; and a gate plate provided between the front plate and the guide, the gate plate being configured to be slidable along the front plate, the gate plate being configured to open and close the opening, the guide includes an inner guide member configured to guide the advancing and retreating of the excavation tool, and an outer guide member configured to support the inner guide member such that the inner guide member is movable to the face side and an anti-face side, wherein the inner guide member has, at a face side end thereof, a first sealing member configured to come into close contact with the gate plate from the anti-face side, and wherein the excavation tool is attached to a tip end of a tool holder arranged in the inside of the inner guide member.

* * * * *